US006354262B2

(12) United States Patent
Wade

(10) Patent No.: US 6,354,262 B2
(45) **Date of Patent: *Mar. 12, 2002**

(54) ROTARY ENGINE AND COMPRESSOR

(76) Inventor: Christopher Bernard Wade, 510 Swanson Road, Ranui, Auckland (NZ)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/043,841

(22) PCT Filed: Sep. 26, 1996

(86) PCT No.: PCT/NZ96/00103

§ 371 Date: Mar. 26, 1998

§ 102(e) Date: Mar. 26, 1998

(87) PCT Pub. No.: WO97/12133

PCT Pub. Date: Apr. 3, 1997

(30) Foreign Application Priority Data

Sep. 26, 1995 (NZ) ..... 280099
Sep. 26, 1995 (NZ) ..... 280100

(51) Int. Cl.[7] ..... F02B 53/00
(52) U.S. Cl. ..... 123/236; 418/261
(58) Field of Search ..... 123/236, 243, 123/247; 418/260, 261, 263, 264, 265, 266, 148

(56) References Cited

U.S. PATENT DOCUMENTS 1,131,072 A * 3/1915 Morin ..... 123/236
1,161,165 A * 11/1915 Smith ..... 123/247
1,324,260 A * 12/1919 Meyer ..... 418/263
1,453,683 A * 5/1923 Kochendarfer ..... 418/266
1,877,250 A * 9/1932 Meyer ..... 123/236
2,158,532 A * 5/1939 Bullen ..... 123/236
3,824,968 A * 7/1974 Brumagim ..... 418/266

FOREIGN PATENT DOCUMENTS

| | | | | |
|---|---|---|---|---|
| DE | 392328 | | 3/1924 | |
| DE | 1551101 | * | 7/1970 | ..... 123/243 |
| DE | 23 36 292 | | 2/1975 | |
| DE | 2611642 | * | 9/1977 | ..... 418/261 |
| GB | 1 500 619 | | 2/1978 | |
| GB | 2 083 557 A | | 3/1982 | |
| JP | 59-119027 | | 7/1984 | |
| JP | 6-229255 | | 8/1994 | |
| WO | WO 95/08699 | | 3/1995 | |
| WO | WO 95/16116 A | | 6/1995 | |

* cited by examiner

*Primary Examiner*—Michael Koczo
(74) *Attorney, Agent, or Firm*—Susan D. Betcher; Seed Intellectual Property Law Group PLLC

(57) ABSTRACT

A rotary type internal combustion engine having stationary stator housing and a rotor, which is rotatably mounted within the stator housing. The rotor has a thrust face, which is exposed to combusted gases within the engine. The thrust face has a variable surface area. The stator has a profiled inner surface or a contoured end cap which varies the surface area of the thrust face exposed to combusting gases and thus provides the engine with a required torque characteristic.

13 Claims, 25 Drawing Sheets

SECTION A-A

SECTION B-B

ROTARY ENGINE AND COMPRESSOR

TECHNICAL FIELD

This invention relates to engines and motors for converting energy in fluids under pressure to rotary motion, and to compressors and pumps for compressing or pumping fluids.

BACKGROUND ART

A rotary type internal combustion engine or motor is disclosed in Patent Co-operation Treaty International Application No. PCT/NZ93/00123. This form of engine has considerable advantages over conventional engines, particularly internal combustion engines, but has scope for improvement in some areas. The primary disadvantage with the engine disclosed in PCT/NZ93/00123 is that a trailing seal is required to provide the rear wall of the combustion chamber. The trailing seal essentially comprises a vane which has limited displacement. This creates two disadvantages. The first is that the geometry of the vane means that at high speeds the vane can tend to jam and not seal properly, thus limiting the attainable compression ratio of the engine, and thus the power output. The second disadvantage is that the limited movement of the vane prevents it from following the contour of the inner wall of the stator so that exhaust gases are not immediately purged.

The rotary type engine or motor disclosed in Patent Co-operation Treaty International Application No. PCT/NZ93/00123 can also be used as a compressor or pump. The form of compressor it discloses has considerable advantages over conventional compressors, particularly those that use a reciprocating piston in a cylinder, or rotary screw but has scope for improvement in some areas. Again, the primary disadvantage with the compressor disclosed in PCT/NZ93/00123 is that a trailing seal is required to provide the rear wall of the compression chamber. The trailing seal essentially comprises a vane which has limited displacement. This creates disadvantages similar to those relating to the engine; the geometry of the vane means that at high speeds the vane can tend to jam and not seal properly, thus limiting the attainable compression ratio, and thus the performance; and the limited movement of the vane prevents it from following the contour of the inner wall of the stator so that it does not assist in drawing inlet gases into the compressor for compression.

Furthermore, it would be advantageous to provide an engine and a compressor that required fewer parts, and that could be easily expanded to provide increased output while having desired torque characteristics.

SUMMARY

It is an object of the present invention to provide an engine, motor, compressor, or pump which will at least go some way toward overcoming the foregoing disadvantages, or which will at least provide the public with a useful choice.

In one aspect the invention consists in an engine or motor for converting energy in fluids under pressure to rotary motion, comprising;

a stator having fluids inlet means for supply of a fluid or fluids to said engine, and fluids exhaust means for the removal of fluid or fluids from said engine or motor, a rotor rotatably mounted relative to said stator, at least two moveable arm means provided on said rotor, said moveable arm means both providing walls of an expansion chamber of said engine or motor.

In a further aspect the invention consists in an internal combustion engine, comprising;

a stator having inlet means for supply of fluids to said engine, and exhaust means for the removal of combusted or expanded fluids from said engine, a rotor rotatably mounted relative to said stator, two moveable arm means provided on said rotor, said moveable arm means both providing walls of a combustion chamber of said engine.

In a further aspect the invention may broadly be said to consist in a method of operating an internal combustion engine, said method comprising the steps of;

supplying an inlet fluid or fluids to a combustion or expansion chamber of said engine, walls of said combustion or expansion chamber including parts of two moveable arm means, igniting said fluids, varying the area of one wall of said combustion chamber exposed to said fluids as said fluids combust while maintaining the area of at least one of the other walls of said combustion chamber substantially constant so as to provide a required engine torque characteristic.

In a further aspect the invention may broadly be said to consist in a method of operating an internal combustion engine, said method comprising the steps of;

supplying an inlet fluid or fluids to a first chamber of said engine, compressing said inlet fluids in said first chamber for supply to a combustion or expansion chamber of said engine, transferring said compressed fluids to said combustion or expansion chamber of said engine, walls of said combustion chamber comprising parts of two moveable arm means, and combusting said fluids to effect mechanical movement.

In a further aspect the invention may broadly be said to consist in a stationary housing for housing an engine or compressor, said housing comprising a central casing having an inner circumferential surface, a part of said inner surface being profiled or contoured to provide an expansion surface and the remainder of said inner surface being of a different profile or contour to said expansion surface, said surfaces being profiled or contoured so that two moveable arm means provided on said rotor are progressively moved relative to said rotor during at least a part of the operating cycle of said engine or compressor.

In a further aspect the invention may broadly be said to consist in a rotor for an engine or compressor, said rotor comprising a body, a support means for mounting said body relative to a stationary housing of said engine or compressor so as to allow relative rotational movement between said body and said housing, said body having a two moveable arm means thereon at least parts of which provide walls of an expansion chamber of said engine or compressor.

In a further aspect the invention may broadly be said to consist in apparatus for compressing or pumping fluids, comprising;

a stator having fluid inlet means for supply of a fluid or fluids to said apparatus, and fluids outlet means for the removal of fluid or fluids from said apparatus, a rotor rotatably mounted relative to said stator, two moveable arm means provided on said rotor, said moveable arm means both providing walls of a compression chamber of said compressor or pump.

In a further aspect the invention may broadly be said to consist in a compressor or pump, comprising;

a stator having gases inlet means for supply of gases to said compressor or pump, and gases exhaust means for the removal of combusted gases from said compressor or pump, a rotor rotatably mounted relative to said stator, two moveable arm means provided on said rotor, said torque link arm means both providing walls of a compression chamber of said compressor or pump.

In a further aspect the invention may broadly be said to consist in a method of operating a compressor or pump, said method comprising the steps of;

supplying inlet fluids to a compression chamber of said compressor or pump, walls of said compression chamber including parts of two moveable arm means, varying the area of one wall of said compression chamber exposed to said gases, and maintaining the area of the other walls of said compression chamber substantially constant so as to provide a required pressure and/or volume of fluids delivered by said compressor or pump.

In a further aspect the invention may broadly be said to consist in a method of operating a compressor or pump, said method comprising the steps of;

supplying inlet fluids to a first chamber of said compressor or pump during part of a compression cycle of said compressor or pump, compressing said inlet fluids in said first chamber for supply to said compressor or pump, transferring said compressed fluids to a compression chamber of a further said compressor or pump, walls of said compression chamber comprising parts of two moveable arm means, and delivering a required volume of said compressed fluids at a required pressure.

In a further aspect the invention may broadly be said to consist in a stationary housing for housing a compressor or pump, said housing comprising a central casing having an inner circumferential surface, a part of said inner surface being profiled or contoured to provide a compression surface and the remainder of said inner surface being of a different profile or contour to said compression surface, said surfaces being profiled or contoured so that two moveable arm means provided on said rotor are progressively moved relative to said rotor during at least part of the operating cycle of said compressor or pump.

In a further aspect the invention may broadly be said to consist in a rotor for a compressor or pump, said rotor comprising a body, a support means for mounting said body relative to a stationary housing of said compressor or pump so as to allow relative rotational movement between said body and said housing, said body having a two moveable arm means thereon at least parts of which provide walls of a working chamber of said compressor or pump.

To those skilled in the art to which the invention relates, many changes in construction and widely differing embodiments will suggest themselves without departing form the invention as defined in the appended claims. The disclosures and descriptions herein are purely illustrative and are not intended to be in any sense limiting.

The invention consists in the foregoing and also envisages constructions of which the following gives examples.

BRIEF DESCRIPTION OF THE DRAWINGS

Preferred forms of the present invention will now be described with reference to the accompanying drawings in which.

DETAILED DESCRIPTION

Figure 1:
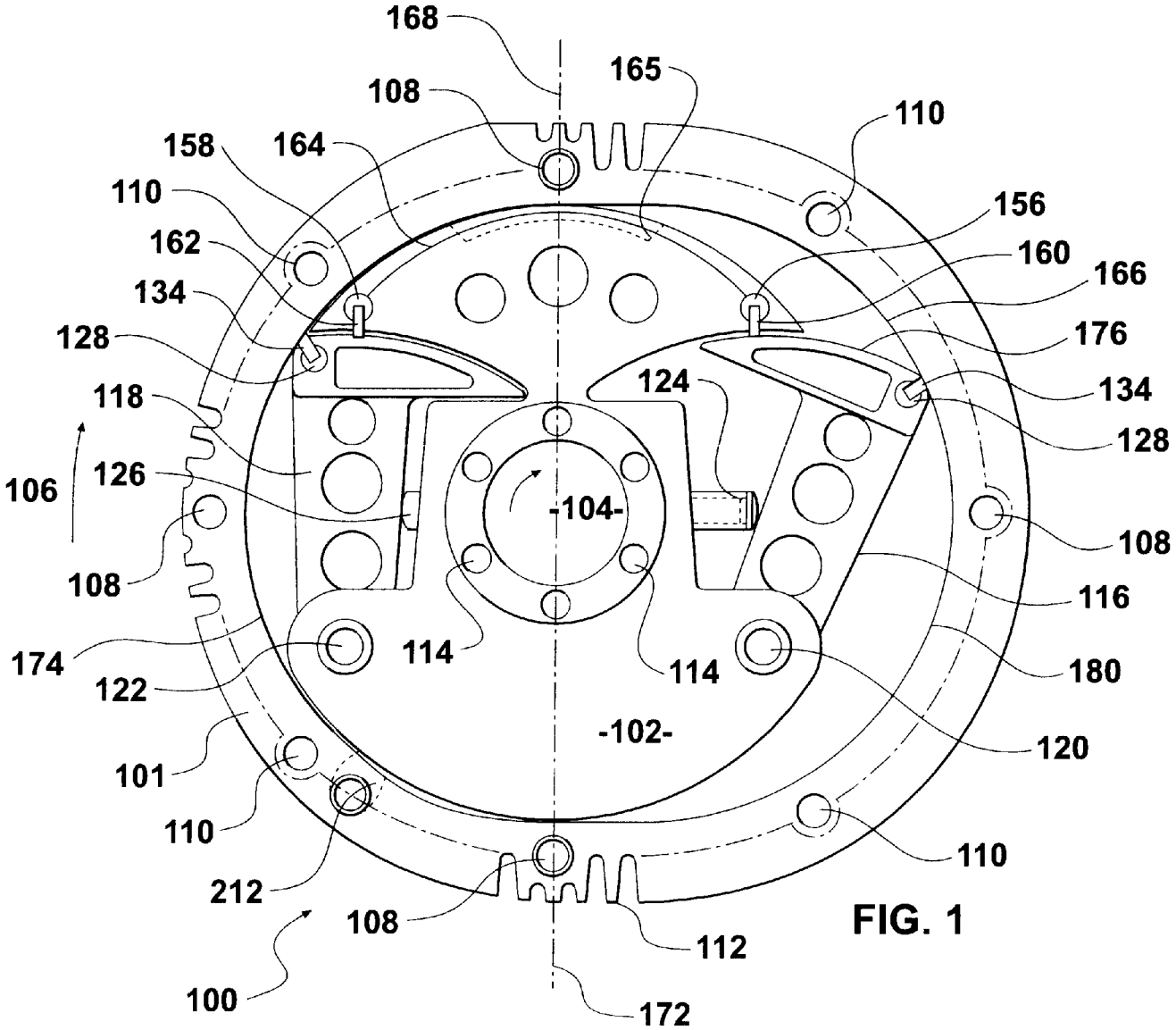
FIG. 1 is a diagrammatic side elevation in cross section of an internal combustion engine in accordance with the present invention.

Referring to FIG. 1, an engine which may be used as an internal combustion engine is shown, generally referenced 100. The engine 100 may be generally referred to as a Rotary Engine, having a stationary housing or stator 101 and a rotor 102 which is rotatably mounted relative to the stator 101. The rotor has an output shaft 104. The normal direction of rotation of the shaft 104 and the rotor is indicated by arrow 106. The stator 101 has holes 108 and 110 about the periphery thereof. Holes 108 are used to stack engines and compressor together, and holes 110 are used to attach front and rear end plates to each engine as will be described further below. The stator also has cooling fins 112 which are preferably disposed about most or all of the outer periphery of the stator. Depending on the cooling method adopted, cooling fins 112 may not be required, as the engine may be cooled by any desirable method, for example liquid cooling.

Holes 114 provided in output shaft 104 and in rotor 102 in use contain bolts for fixing the shaft to the rotor. The rotor has two moveable means 116 and 118 which are leading and trailing moveable arms, respectively, and which are pivotally connected to rotor 102 by pins or the link 120 and 122. Moveable arms 116 and 118 are biased against inner walls of the stator 101 by sprung members 124 and 126 so that the moveable arms wipe inner surfaces of the stator. Other biasing methods could also be used. As can be seen from FIG. 1, recesses are provided in the rotor 102 to allow moveable arms to move generally radially relative to the rotor as the rotor rotates relative to the stator.

Figures 2, 3, 4, 5, 6, 7:
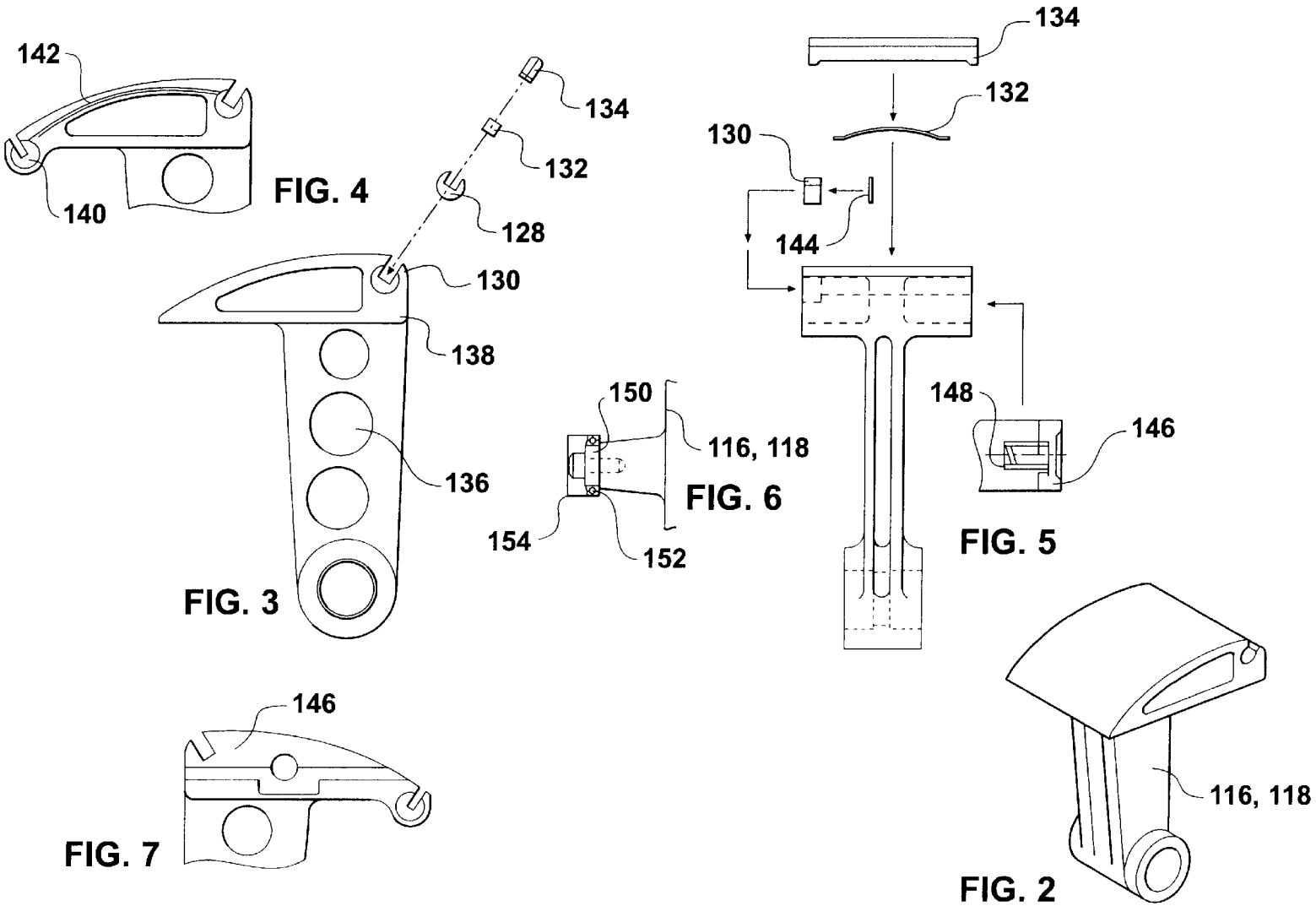
FIG. 2 is an isometric view of a moveable torque link arm of the engine of FIG. 1.
FIG. 3 is a side elevation of the moveable arm shown in FIG. 2, showing part of the seal assembly.
FIG. 4 is a partial side elevation of an alternative moveable arm to that shown in FIGS. 2 and 3.
FIG. 5 is an exploded end elevation of another alternative torque link arm and sealing arrangement.
FIG. 6 is an end elevation of an optional guiding cam for use with the moveable arms of the preceding figures.
FIG. 7 is a partial side elevation of the moveable arm shown in FIG. 5.

Referring to FIG. 2, one of the moveable arms 116 and 118 is shown in isometric view for clarity.

The preferred moveable arm sealing arrangement is shown in FIG. 3, in which a button seal 128 is shown and which is in use located in edge 130 of the torque link arm. The button seal contains a leaf spring 132 which biases a moveable arm edge seal 134 against the inner surfaces of the stator 101. One or more holes 136 may be provided in the moveable arms to reduce their mass.

The moveable link arm of FIG. 3 has side surfaces 138 which are preferably machined sufficiently accurately to provide a seal between the moveable arm and the front and/or rear end caps of the engine. Therefore, only one of seals 128 and 134 are required on each moveable arm. However, in some applications, the desired quality of the sealing surface on side surfaces 138 may not be able to be achieved, in which case the alternative shown in FIG. 4 may be used. As can be seen from FIG. 4, a further button seal 140 is provided which contains a further spring and edge seal (not shown), and a side seal 142 is provided between the two button seals.

Referring to FIG. 5, the button spring 144, which holds button seal 130 in contact with the front and/or rear end plates is shown together with another alternative sealing method which comprises a torque link arm end cap 146 which is biased against the front and/or rear end plates of the engine by spring 148. The cap is machined to provide a seal.

FIG. 6 shows a cam follower 150 which is provided on a part of the torque link arm, for example on the central web of the moveable arm, for guiding the moveable arm relative to the stator inner surface. This arrangement is necessary for some relatively large embodiments of the invention, as the mass of the rapidly rotating moveable arms can impose unacceptably high forces on the seals 134. The cam 150 is shown within a ball race 152 so that it may move relative to a groove 154 provided in a wall of the front or rear end plates of the engine. In this arrangement the moveable arm load is carried by the front or rear end plates rather than the seals 134.

FIG. 7 shows a side elevation of the moveable arm end cap 146 of FIG. 5.

Referring again to FIG. 1, the rotor 102 has button seals 156 and 158 which contain edge seals 160 and 162. Between these seals, and edge seal 164 is provided. As will be seen from the following description, the position of the pivotal attachment of the moveable arms to the rotor provides maximum rotational moment, and the rotor as a whole has sufficient inertia to eliminate the need for a flywheel.

In the position shown in FIG. 1, the engine is part way through the expansion or combustion phase of the engine operating cycle. Moveable arm 116 has moved radially pivotally away from the centre of rotor 102 as it follows the contour of the profiled inner surface 166 of the stator which in FIG. 1 extends from Top Dead Center (TDC) at 168 to point 172. Combustion occurs until exhaust which is located at point 170, but could be varied with variations in engine design. The remainder of the inner surface, which is preferably concentric, and almost conterminous with the outer periphery of the body of the rotor 102, is referenced 174. The angular extent of the surfaces 166 and 174 can be varied as long as seal 134 of the trailing moveable arm 118 is in contact with surface 174 while the leading moveable arm 116 is in the combustion phase between the point of ignition and exhaust.

The working chamber, which may also be referred to as the combustion chamber or expansion chamber, is effectively provided between the sealing edge surfaces of moveable arms 116 and 118, seals 128 and 134 of each moveable arm, seals 156, 158, 160, 162 and 164, and the inner surfaces 170 and 174. The edge seal 164 is curved so that it is not concentric with the rotor to prevent it wearing a groove in the inner surfaces of the end caps. A combustion region or "cell" 165 is provided in the rotor. Positioning the combustion cell in the rotor, rather than the stator, provides the advantage that there is no space in the stator from which combusted gases are difficult to extract.

As can be seen from FIG. 1, the area 176 of leading moveable arm 116 that is exposed to combusting gases is much greater than the area of the trailing moveable arm between seals 162 and 134 that is exposed. Therefore, the rotor will move in the direction of arrow 106.

Figure 8:
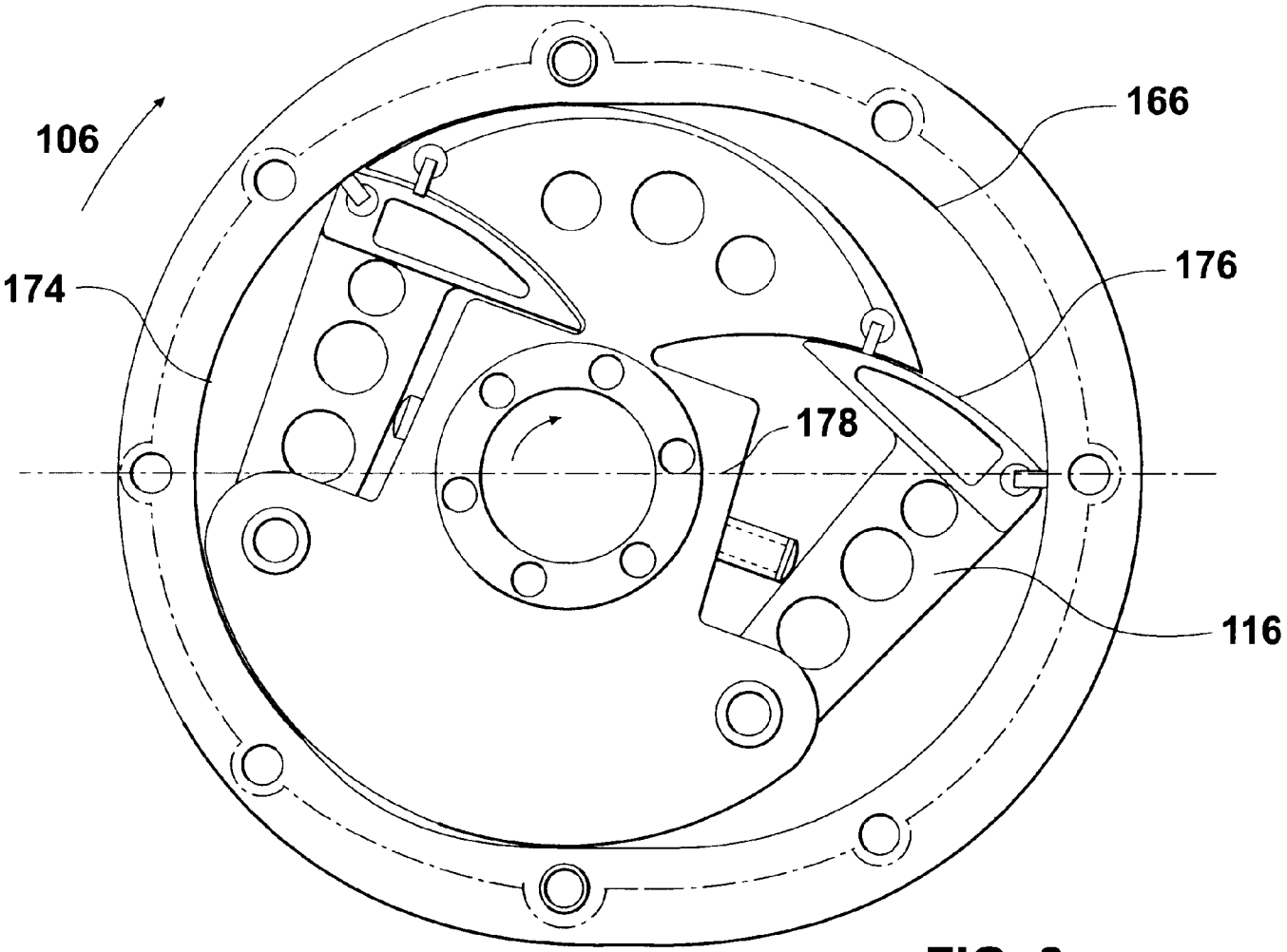
FIGS. 8, 9 and 10 are diagrammatic side elevations in cross section of the engine of FIG. 1 during the combustion phase, at exhaust, and at Top Dead Center (TDC) ready for combustion, respectively.

Referring to FIG. 8, the engine is shown at a position where the maximum area of face 176 of the leading moveable torque link arm 116 is exposed to combusting gases. As the trailing moveable arm is still in part 174 of the stator inner surface, the position shown in this figure is that of maximum torque. In the example illustrated in the figures, the profile of the expansion surface 166 is circular and is centred about centre 178. However, the expansion surface 166 could be any desired profile to achieve a desired torque characteristic for the engine, as the variation of torque relative to rotor angular position is primarily dependent on the area 176 of the leading moveable arm which is exposed to combusting gases. This, in turn, is dependent on the profile of surface 166.

Figure 9:
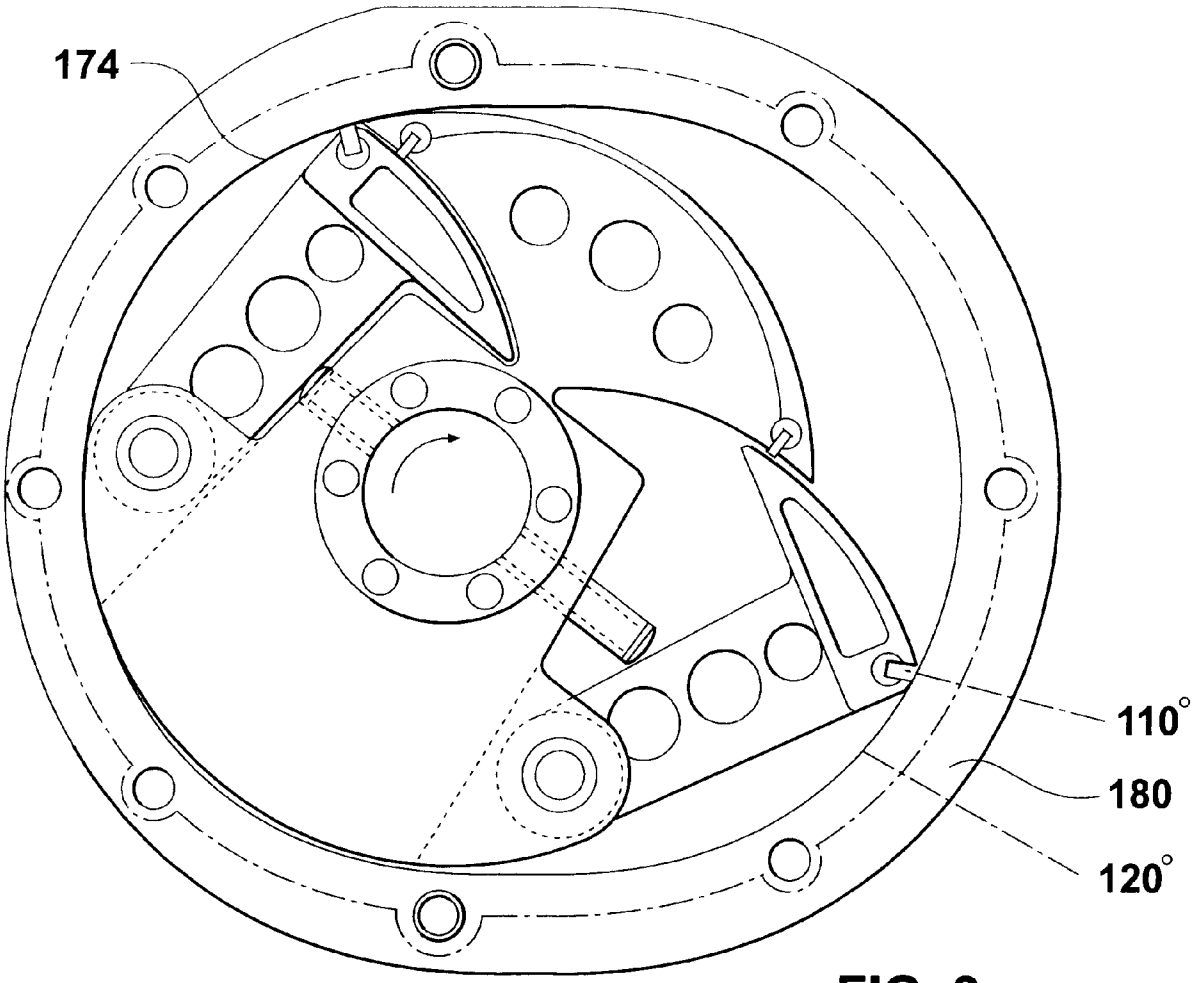

Referring to FIG. 9, the engine is shown at exhaust. The combustion phase is completed and the combusted gases exit the combustion chamber through the exhaust port 180, which is in this example located between 110 and 120 crank angle degrees after TDC. It will be seen that the trailing moveable arm 118 is still in region 174 of the inner surface at this point.

Figure 10:
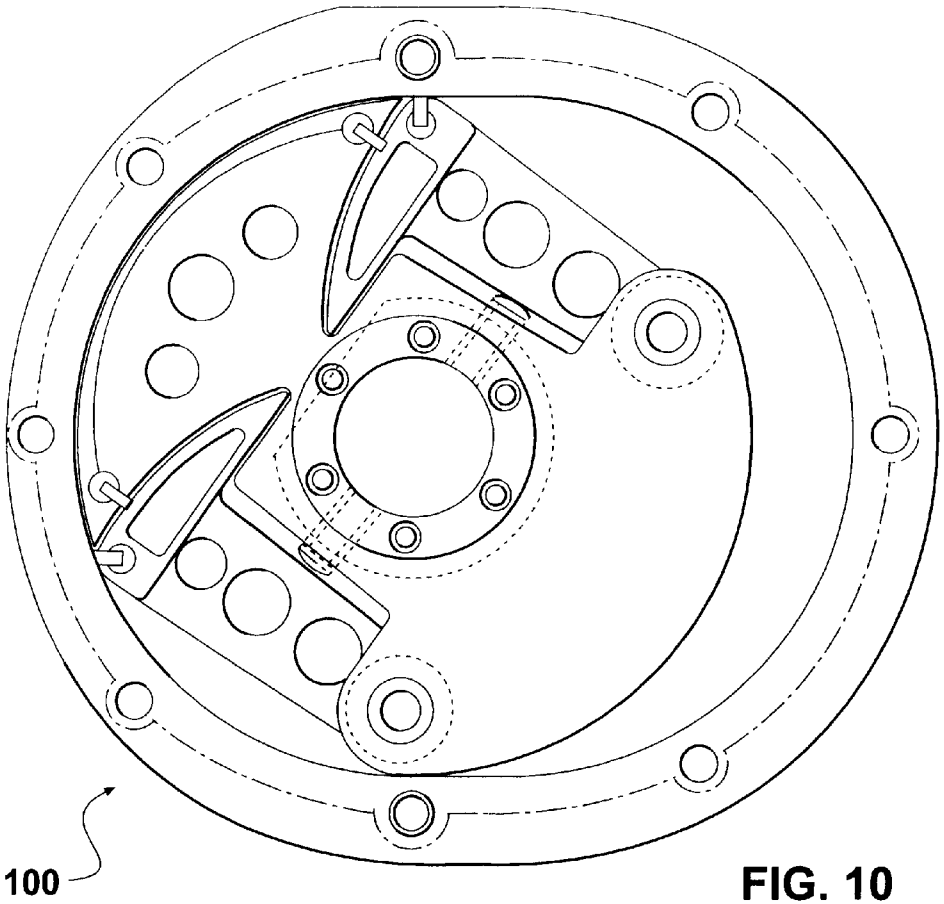

In FIG. 10, the engine is shown at TDC, which may be immediately prior to, after, or at the point of, ignition. The exact timing of ignition will depend on a number of factors, including the type of fuel the engine is burning. The engine provides the significant advantage that relatively slow burning fuels, such as kerosene, could be used because the tangential transition in profile between surfaces 174 and 170 provides a region in which the volume of the combustion chamber does not expand rapidly. This allows the gases time to begin combusting before work needs to be done on the exposed leading moveable arm surface 176. Clearly, the dimensions or geometry of the combustion chamber can be varied by variation of the geometry of the stator housing. In this way the burn time of the combusting fuel can be varied and the rate of combustion of fuel can be accelerated or decelerated depending on the type of fuel used. The burn time can thus be varied by design.

It will also be seen that a plurality of spark plugs, or equivalent devices, can be placed about the stationary housing to prolong or change the rate of combustion of fuel in the combustion chamber. Thus an "after burn" affect can be achieved to ensure desired combustion characteristics necessary for desired performance. For example, a further spark plug can be provided 45 rotational degrees after the first, and could be selectively sparked some variable time period after the first spark plug, depending on engine speed and fuel type, to give the most efficient burn or the burn most required for the required engine performance.

Also, some of the engine components can be constructed from ceramic materials or be ceramic coated, so highly acidic fuels can be used and high efficiency is possible. Furthermore, lubrication of the engine seals can be effected by the fuel itself, so a crankcase for lubricant is not necessarily required. In the position shown in FIG. 10 the combustible gases are trapped in the combustion chamber between the two moveable arms.

Figure 11:
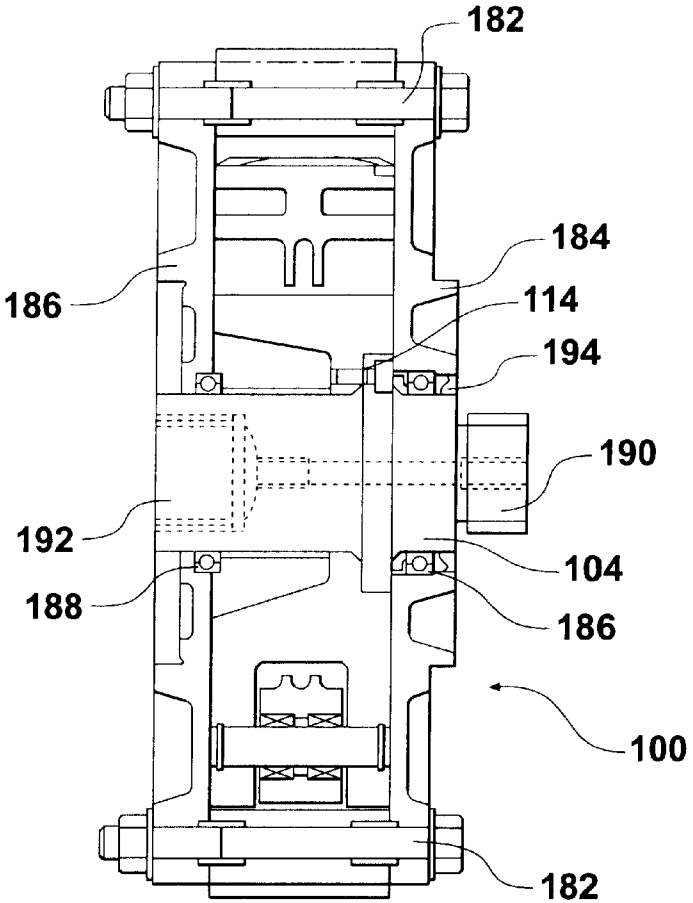
FIG. 11 is a diagrammatic and elevation in cross section of the engine of the preceding figures.

FIG. 11 shows the engine in end elevation in cross section, in which tie bolts 182 hold the front and rear end plates 184 and 186 in place either side of the stator. The output shaft 104 is supported by bearings 186 and 188 and includes male and female splines 190 and 192 for stacking engine and compressor modules as will be described further below. A seal 194 is provided between the front end cap 184 and the shaft 104.

Figure 12:
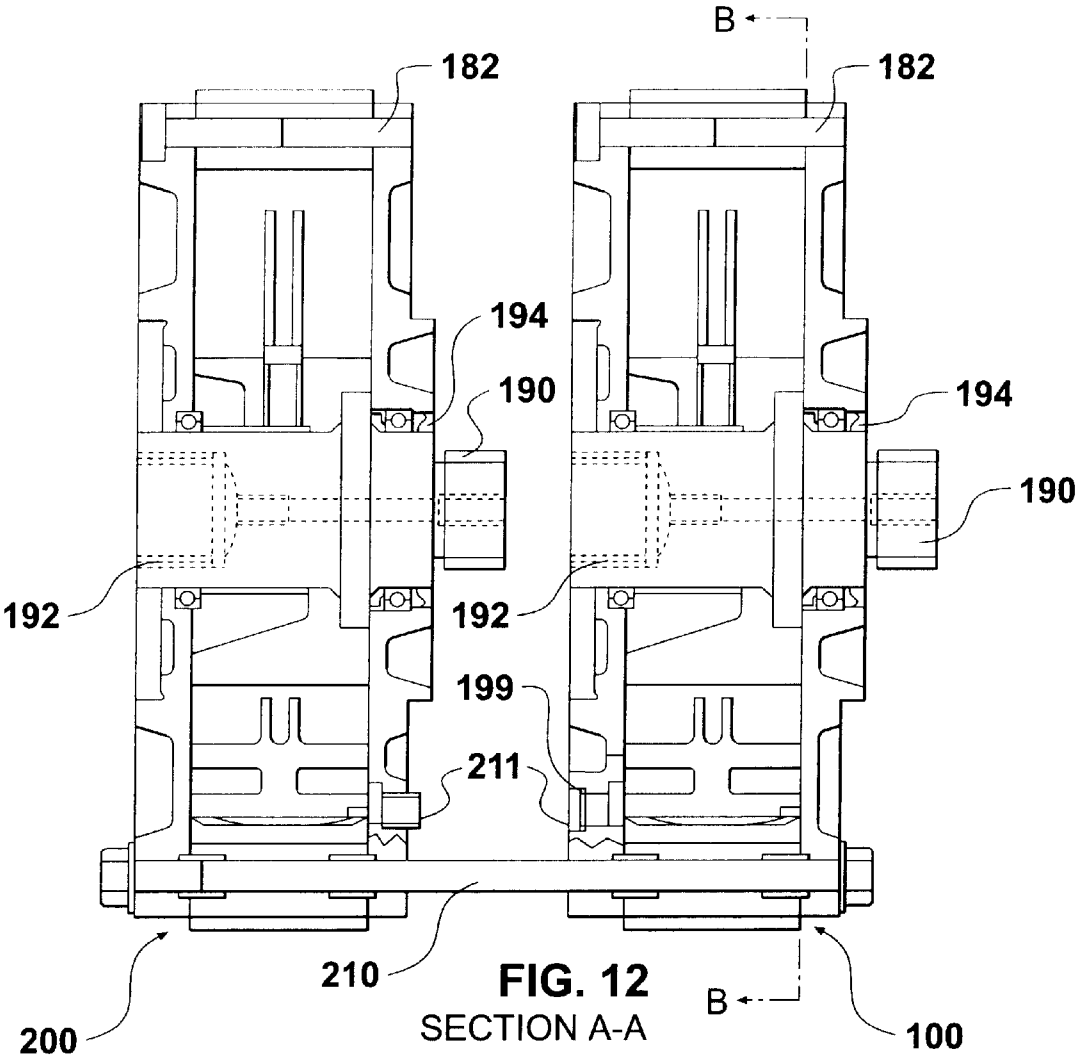
FIG. 12 is a diagrammatic and elevation in cross section through A—A of FIG. 13 of the engine of the preceding figures shown stacked with a compressor.

Turning to FIG. 12, an engine 100 as shown in the preceding figures is shown ready to be stacked to a compressor 200. The compressor operation is described further below. Tie bolts 210 are used to connect the engine and the compressor together. It will be seen that the design is such that any number of compressor and engine units can be stacked together. In particular, side mounted transfer ports 211 are provided to allow transfer of gases between the engine and compressor when they are stacked together. An "O"-ring seal 199 provides a seal between the ports.

Figure 13:
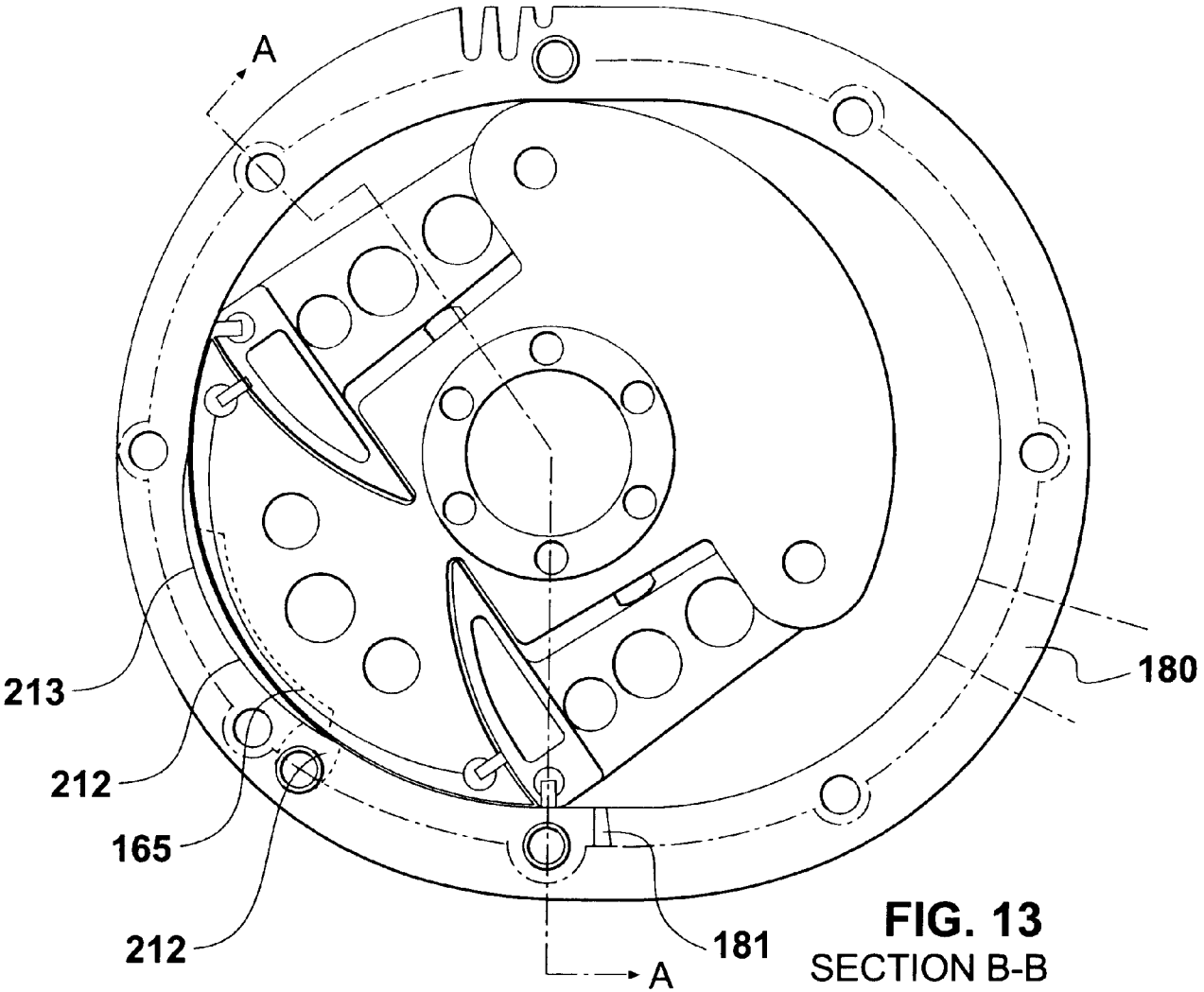
FIG. 13 is a diagrammatic side elevation in cross section through B—B of FIG. 12 showing part of the inlet phase of the engine cycle.

In FIG. 13, the engine is shown at the inlet position in which a combustible mixture of compressed gases and fuel enters the engine through inlet port 212, which in the present example is provided between 235 and 245 crank angle degrees after TDC. An inlet receiving area 213 is provided about the inlet port 212. The area 213 is provided by changing the contour of the inner wall of the stator adjacent to the inlet 212 so that additional space is provided between the rotor and the stator. It can be seen that the combustion cell 165 in the rotor also provides further space. The purpose of the receiving chamber is to allow transfer of inlet gases at or below the pressure they are supplied from a compressor such as that described further below. Thus a full transfer of compressed gases is allowed. If insufficient volume is provided in the engine for the pressurised inlet gases, then not all of the gases will be transferred. The contour of the inner stator surface in receiving area 213 is followed by the trailing moveable arm 118 which sweeps area 213. After the trailing arm 118 passes the inlet port 212, effectively closing the inlet port, it returns to the concentric portion of the inner stator wall. In returning to the concentric portion, the volume between the two moveable arms is reduced, so the inlet mixture is effectively compressed. When the engine is operating as a diesel, this final compression work can be used to bring the pressure of the inlet mixture up to the point where combustion occurs. Thus, the receiving area 213 can be designed so that the point of maximum inlet gases pressure is reached when the leading piston is at TDC, or at another desired point for initiation of the combustion phase. When the engine is operating as an internal combustion engine in a non-diesel application, the final compression work allows supercharging of the engine.

The other major advantage of the receiving area 213 is that it allows more time in which the compressed inlet gases can transfer from the compressor into the engine. Without area 213 the major part of the total volume available to receive inlet gases is the combustion cell 165. In operation this passes the inlet port 212 very quickly, as it is relatively short in relation to the circumference of the rotor, so it provides only a very short effective gas flow path for gases to flow from the inlet port into the engine. The receiving area 213 provides a much longer gas flow path as can be seen from figure 13*a*. Referring to that figure, the rotor 102 is shown in two different positions, firstly where the leading edge 167 of the combustion cell 165 just overlaps the leading edge of area 213, and secondly, where the trailing edge 169 of the combustion cell just overlaps the trailing edge of area 123. As soon as the first position is realised, gases can begin transferring through the inlet port 212 and into the space provided, and the gas transfer can continue until the second position is realised. The effective cumulative arc over which gas transfer can occur is arc 215 plus 217 plus 219. In use, this represents a much greater period of time for gas transfer to take place.

Figure 13A:
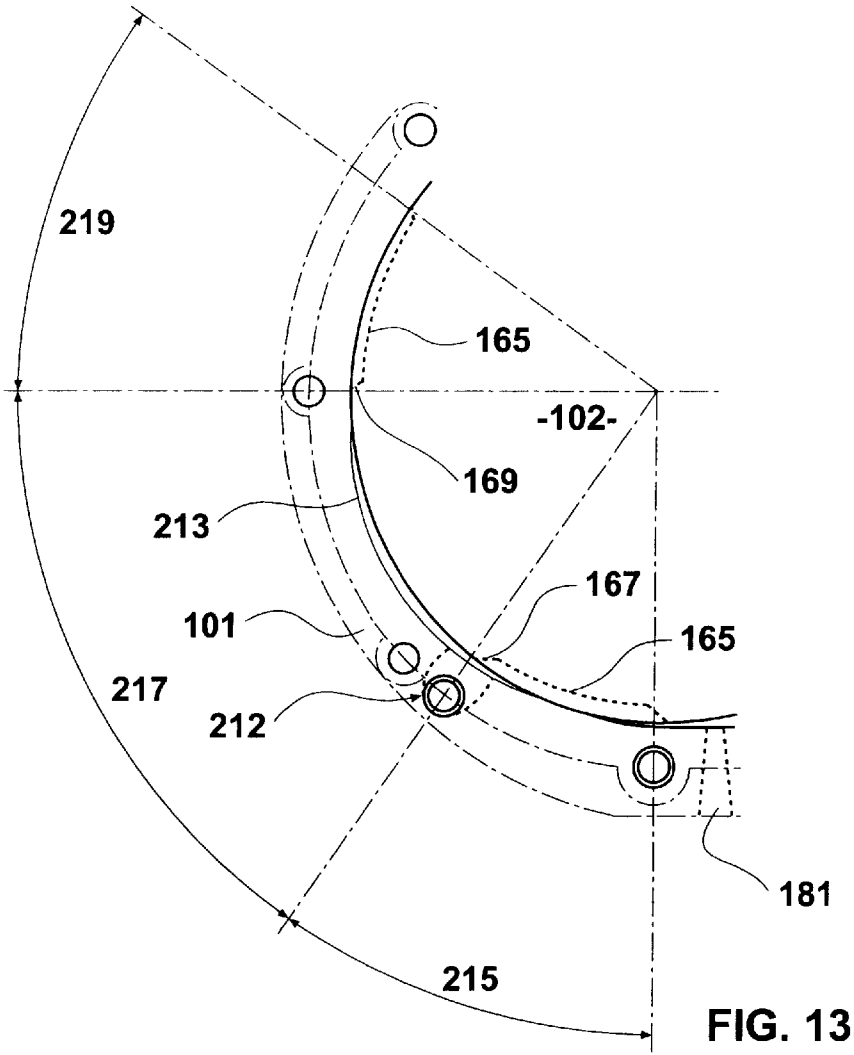
FIG. 13*a* is a partial diagrammatic side elevation in cross section through B—B of FIG. 12 showing the rotor in two different positions during the inlet phase.

Referring to FIG. 13*a,* the trailing moveable arm 118 purges or scavenges remaining exhaust gases as it sweeps surface 170 as it rotates to the position shown in FIG. 13. It is possible that some exhaust gases may remain trapped between the moveable arms after the trailing moveable arm has passed exhaust port 180. A secondary exhaust port 181 is provided to allow any remaining exhaust gases to escape. Although not shown in FIG. 13*a,* some overlap can be provided between the initiation of the inlet phase and the initiation of secondary exhaust through port 181. Thus port 181 is located in such a position that the gases entering the engine through the inlet port 212 can assist in purging any remaining exhaust gases out secondary port 181. The overlap is preferably approximately 5 crank angle degrees.

Figure 14:
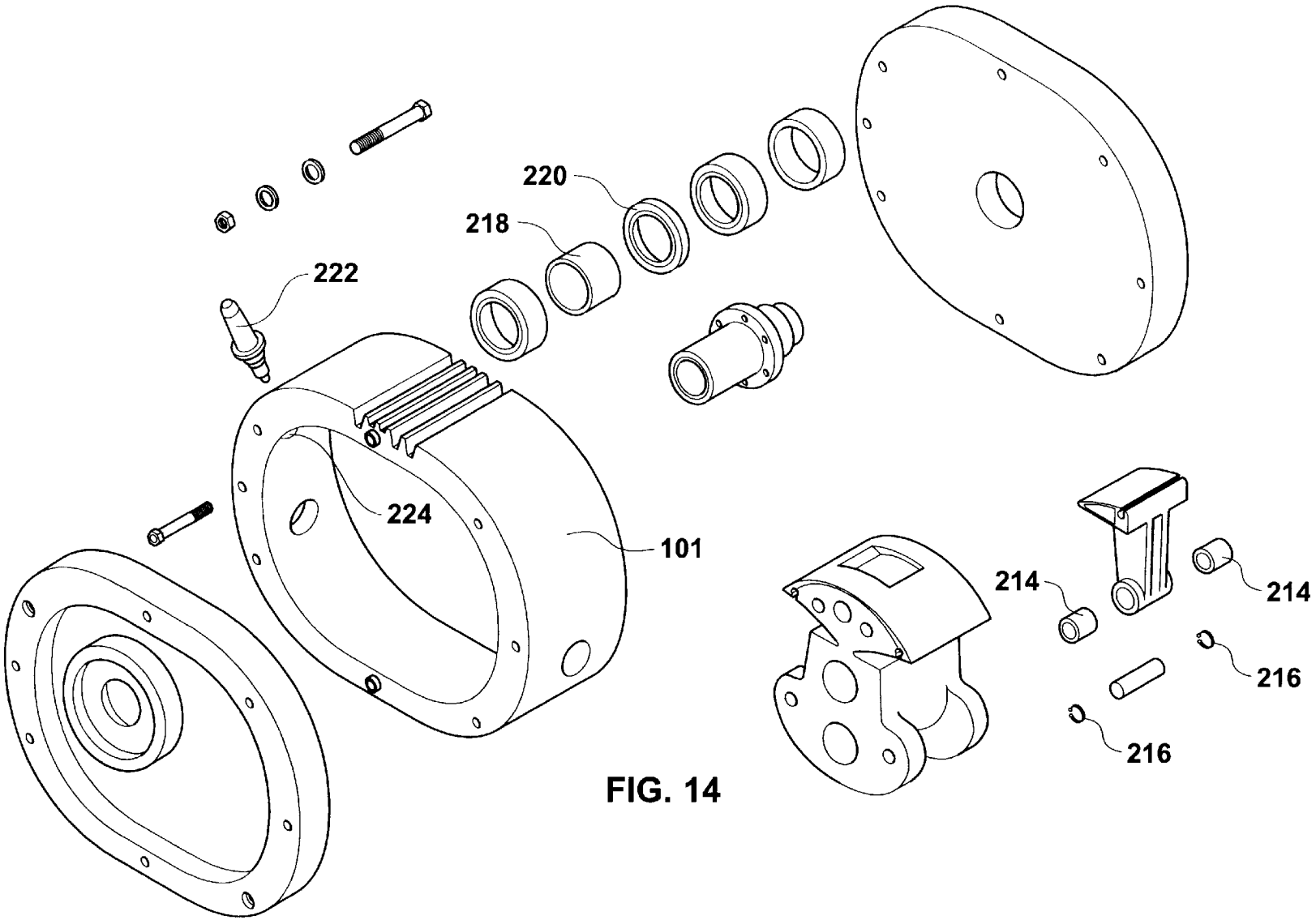
FIG. 14 is a diagrammatic exploded isometric view of the engine of the preceding figures.

An exploded view of the engine 100 is shown in FIG. 14, in which moveable arm bearings 214 and circlips 216 can be seen, together with shaft spacers 218 and 220, and spark plug 222 which is in use disposed in aperture 224 provided in stator 101.

The operation of the compression 200 will now be described with reference to FIGS. 15 and 16. The compressor may be a stand alone unit. It could be driven by a conventional engine or an electric motor, for example, to provide a supply of compressed gases. Compressor 200 supplies compressed gases, and preferably supplies these with fuel so that a compressed combustible mixture of gases is provided.

Figure 15:
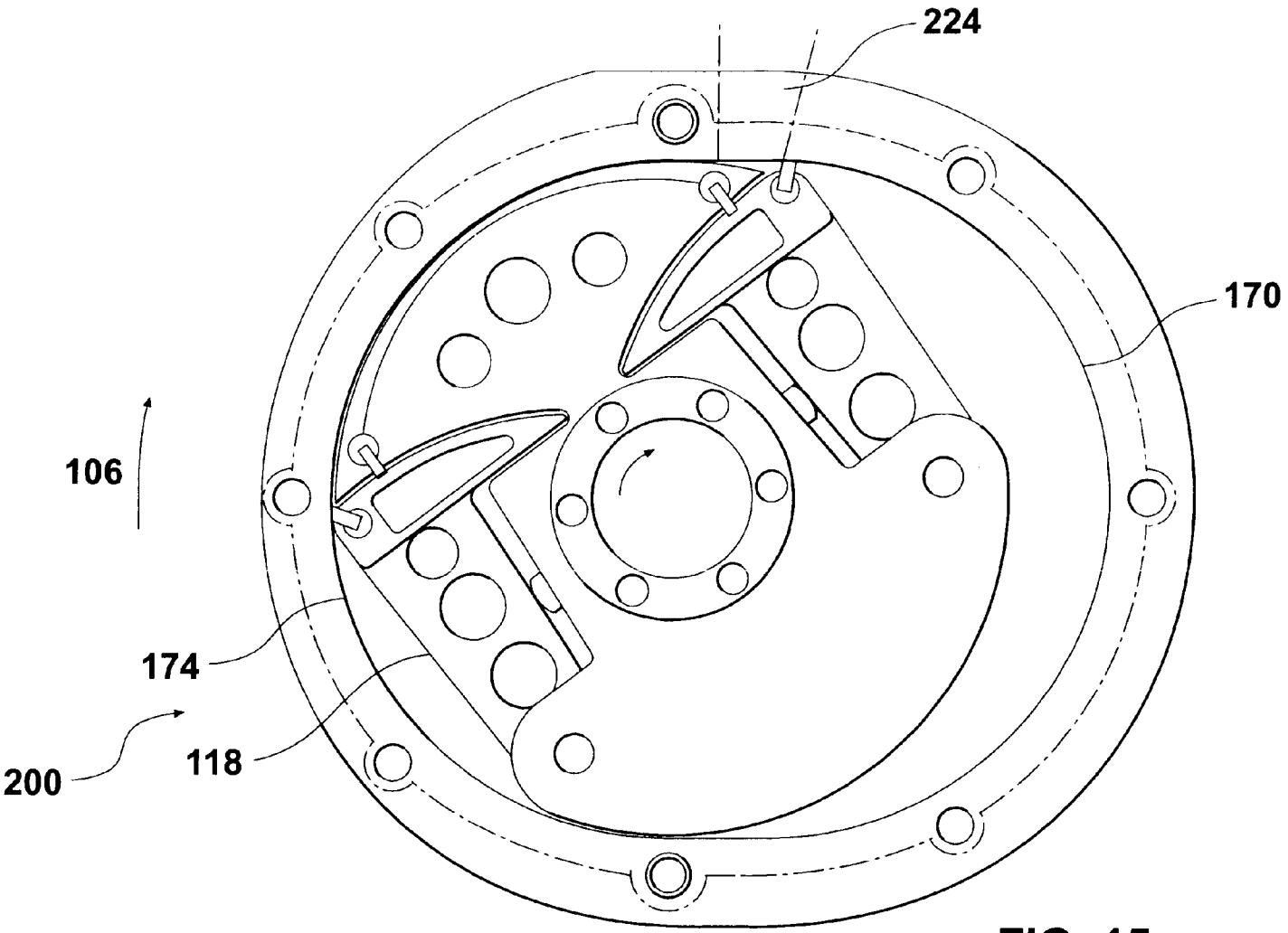
FIGS. 15 and 16 are diagrammatic side elevations in cross section of a compressor in accordance with the present invention, shown at inlet, and at exhaust, respectively.

Referring to FIG. 15, the compressor 200 has the same constituent parts as the engine 100, and these parts have the same reference numerals. The primary differences are that the shaft 104 drives the compressor rather than being an output shaft, and that the gasses inlet and outlet ports are provided in different positions. These ports have been given references 224 and 226 respectively. As can be seen in FIG. 15, inlet port 224 has effectively been "opened" as the leading moveable arm 116 has passed over it. As the leading moveable arm follows contour 170 of the stator inner wall, the volume between the moveable arms will increase rapidly, drawing gases through the inlet port 224. After trailing moveable arm 118 passes over the inlet port, the inlet gases are trapped between the moveable arms.

Figure 16:
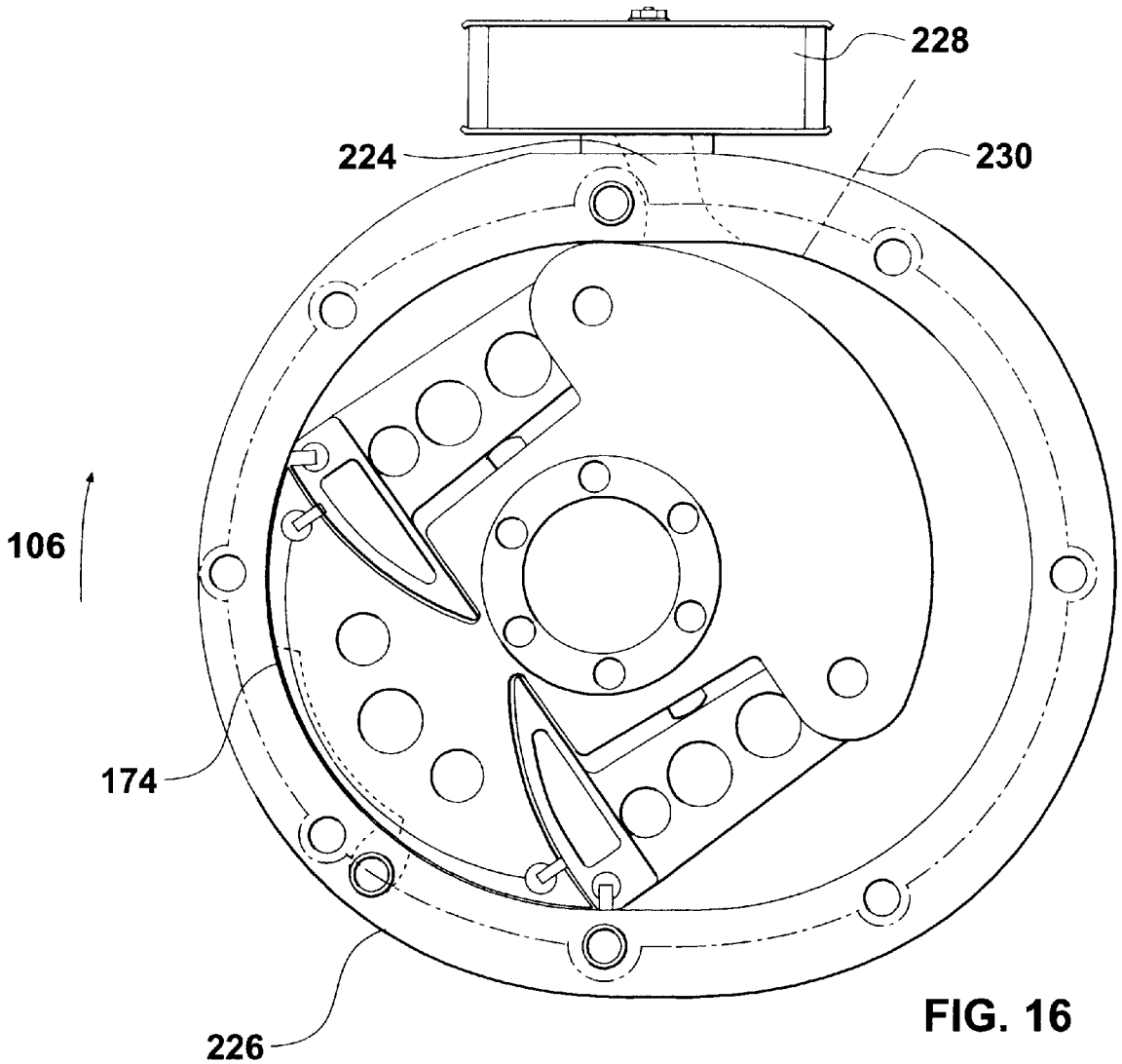

In FIG. 16 the rotor has rotated to a position in which compressed gases are exiting the compressor through the outlet port 226. The gases are compressed by the reduction in volume as the trailing moveable arm 118 is forced back toward the body of the rotor 102 by the inner surface profile 166 as it returns to inner surface 174 as shown in FIG. 16. An optional air filter 228 is also shown adjacent to the inlet 224, and to provide compressed combustible gases at outlet 226, a fuel injector may be provided at position 230 in the stator 102.

The compressor 200 may be used with an engine 100 as shown in FIG. 12. As can be seen from that figure, male spline 190 of the compressor input shaft engages with the female spline 192 of the engine output shaft. The compressor is therefore driven by the engine, and the outlet port 226 of the compressor is connected through the stator 101 to inlet port 212 of the engine. A desired relative angular position between the engine and compressor rotors can be established so that compressed combustible gases are supplied to the engine at the required time. This can be varied to provide desired compression ratios, and desired timing of gases transfer which may be dependent on the speed the engine is to operate at, for example. Bolts 210 are used to stack the engine 100 and the compressor 200 together.

Thus the engine and compressor together have four distinct cycles or phases of inlet, compression, combustion and exhaust of similar duration's to those of traditional four stroke reciprocating engines, but the present invention performs all four phases within 360 crank angle degrees, whereas traditional four cycle engines require 720 crank angle degrees to perform these. A particular advantage with the present invention is that the duration of each of the four phases can be controlled by variation of the stator inner surfaces and the position of the leading and trailing moveable arms on the rotor. Because the engine fires once every 360 crank angle degrees, it has at least twice the work output per cycle of a traditional four cycle reciprocating engine which requires two revolutions for the four strokes. Thus the engine of the present invention is comparably dimensionally smaller than a traditional reciprocating engine of equivalent horsepower.

The compression ratios can be easily varied by substitution or redesign of the compressor module, and the burn time and timing of ignition and gases inlet and exhaust can be varied by design. Also, because the burn time can be varied, the engine can be designed to burn fuel cleanly with minimal toxic emissions.

Any number of engine and compressor units, within reason, may be interconnectably stacked together by means of interconnecting splines 190 and 192 of alternate engine and compressor units so that the arrangement shown in FIG. 12 is duplicated. The interconnected units can be held in stacked position by bolts 210, which are provided in appropriately varying lengths. Thus a plurality of engine and compressor units may be stacked together to multiply the power output of a single engine and compressor unit. The relative angular position of the interconnected engine units can be varied to vary the torque output. For example, if two engines are connected in phase, the torque throughout the combustion phase will be doubled, whereas if they are connected 180 degrees out of phase, the torque will be distributed. Clearly, a plurality of engine and compressor units can be connected so that each engine and compressor unit is slightly out of phase with its neighbour so that a substantially even torque output can be achieved. Furthermore, each engine and compressor do not have to be located adjacent to each other. The invention allows compressors and engines to be grouped separately. In this way a plurality of compressors can be directly stacked together with the output of the first being directly input to the next so as to multiply the achievable compression ratio. The resultant output of the compressors is then fed into one or more engines which a stacked in such a way as to achieve a desired torque characteristic as described above.

As described above, the variation in torque through the combustion phase can be varied by design, as the torque output is dependent on the contour of the profiled inner surface 166.

The trailing moveable arm of the present invention provides two distinct advantages over the prior art. The pivotal connection between the moveable arm and the rotor, and the ability of the trailing moveable arm to follow the inner surfaces 166 and 174 of the stator, provides a superior seal to that of the prior art and thus allows much higher compression ratios to be achieved with the present invention, with the result that the engine is more efficient than prior art embodiments. Also, the trailing moveable arm allows effective purging of scavenging of combusted gases.

The effective provision of the combustion chamber in the rotor removes the necessity for a chamber to be formed in a part of the inner surface of the stator. A chamber of some sort is necessary to contain the gases at the point of ignition. A chamber provided in the stator has the disadvantage that it is difficult to purge of exhaust gases.

The embodiment of the present invention described with reference to the preceding drawings has a minimal number of components, however, it will also be seen that more than two moveable arms could be provided, as long as the stator and rotor are designed so that when one moveable arm is in the combustion phase, the moveable arm immediately following it is in a concentric part of the stator inner surface.

The rotors of both the compressor and the engine are identical, thus leading to simpler manufacture and reduced cost of manufacture.

Figure 17:
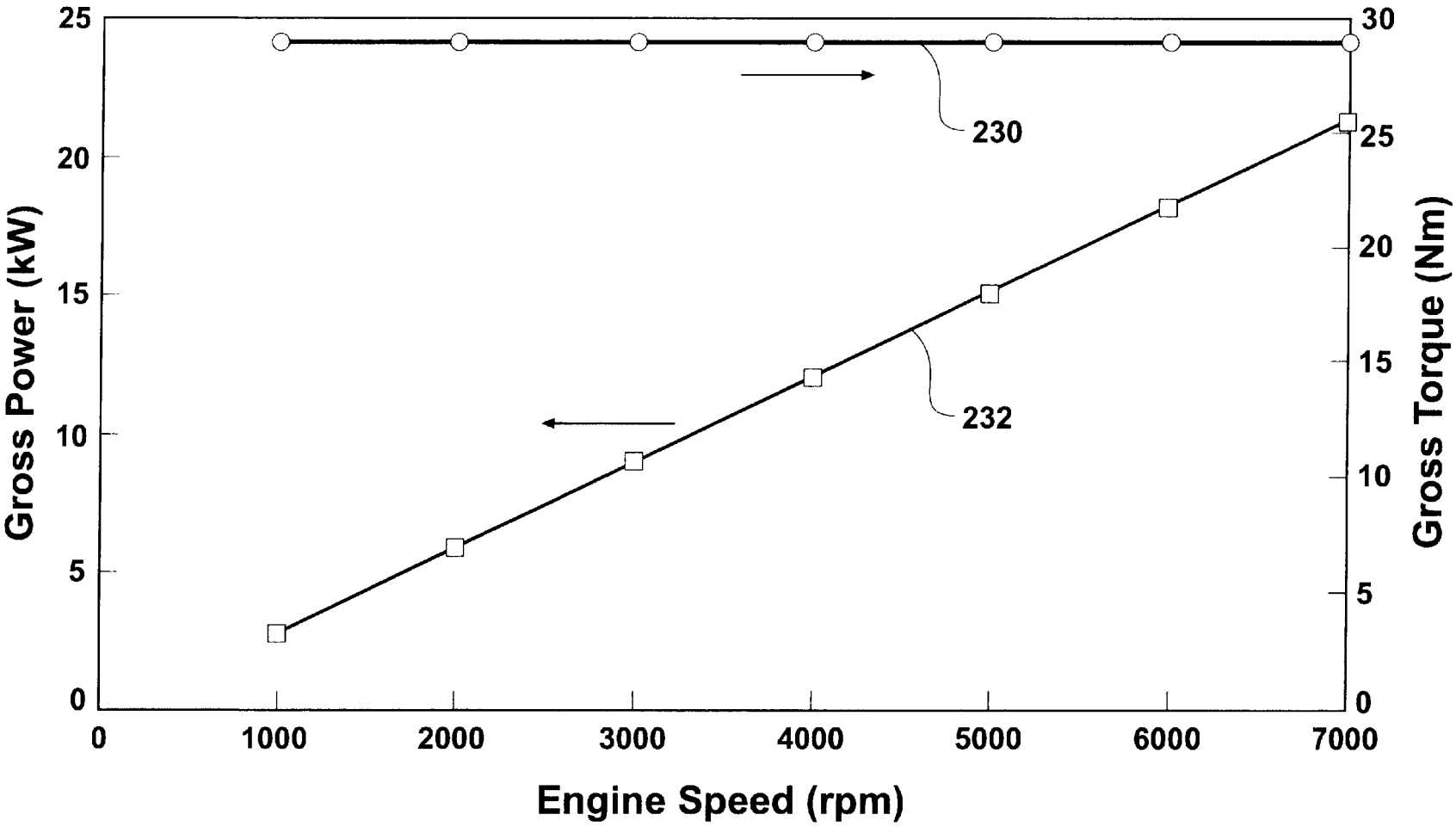
FIG. 17 is a graph of gross power (kW) and gross torque (Nm) vs engine speed (rpm) for ideal model results for an engine in accordance with the present invention.
Figure 18:
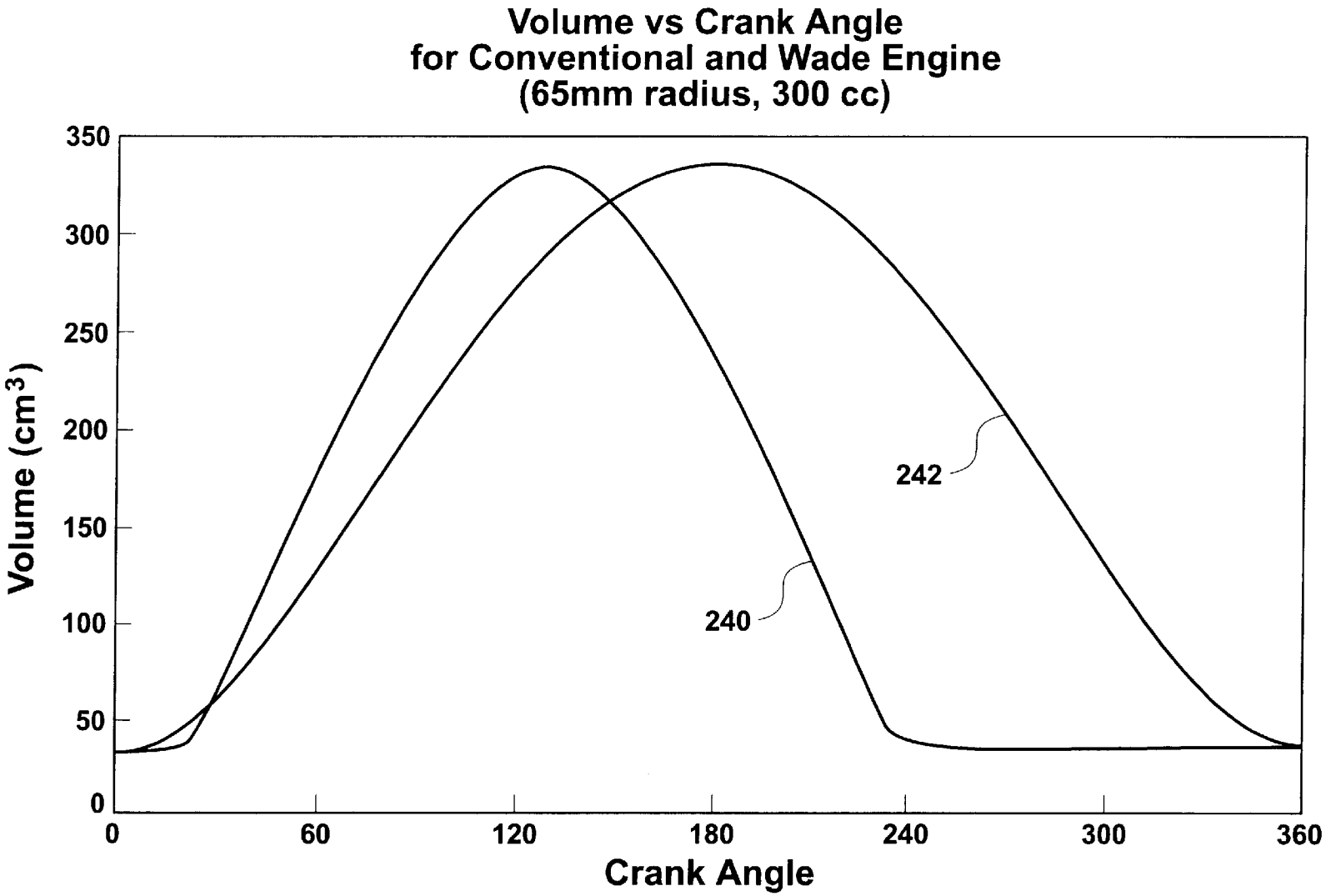
FIG. 18 is a graph of engine volume (cubic centimetres) vs crank angle (degrees after Top Dead Center)
Figure 19:
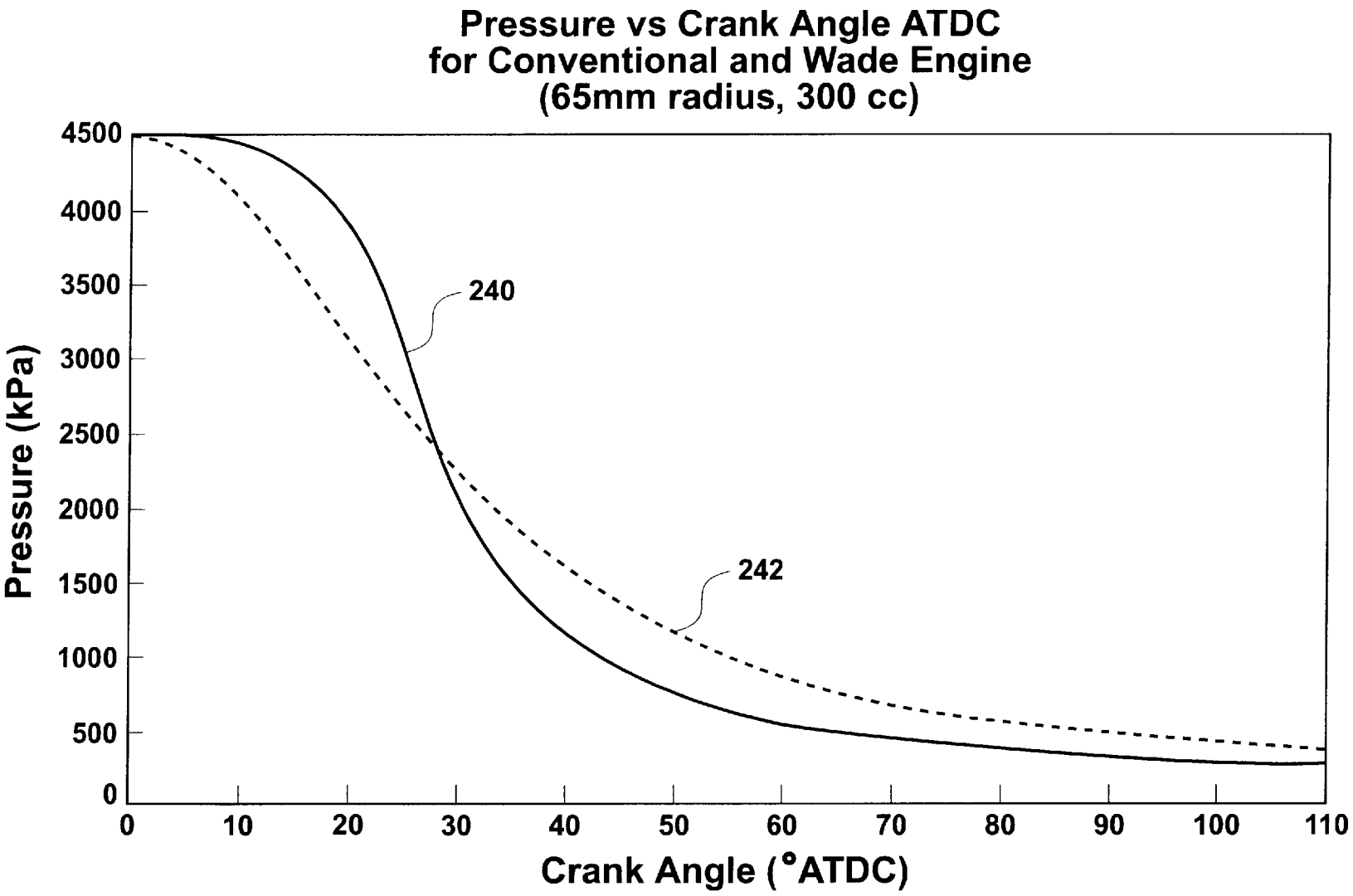
FIG. 19 is a graph of combustion chamber pressure (kPa) vs crank angle (degrees after Top Dead Center)
Figure 20:
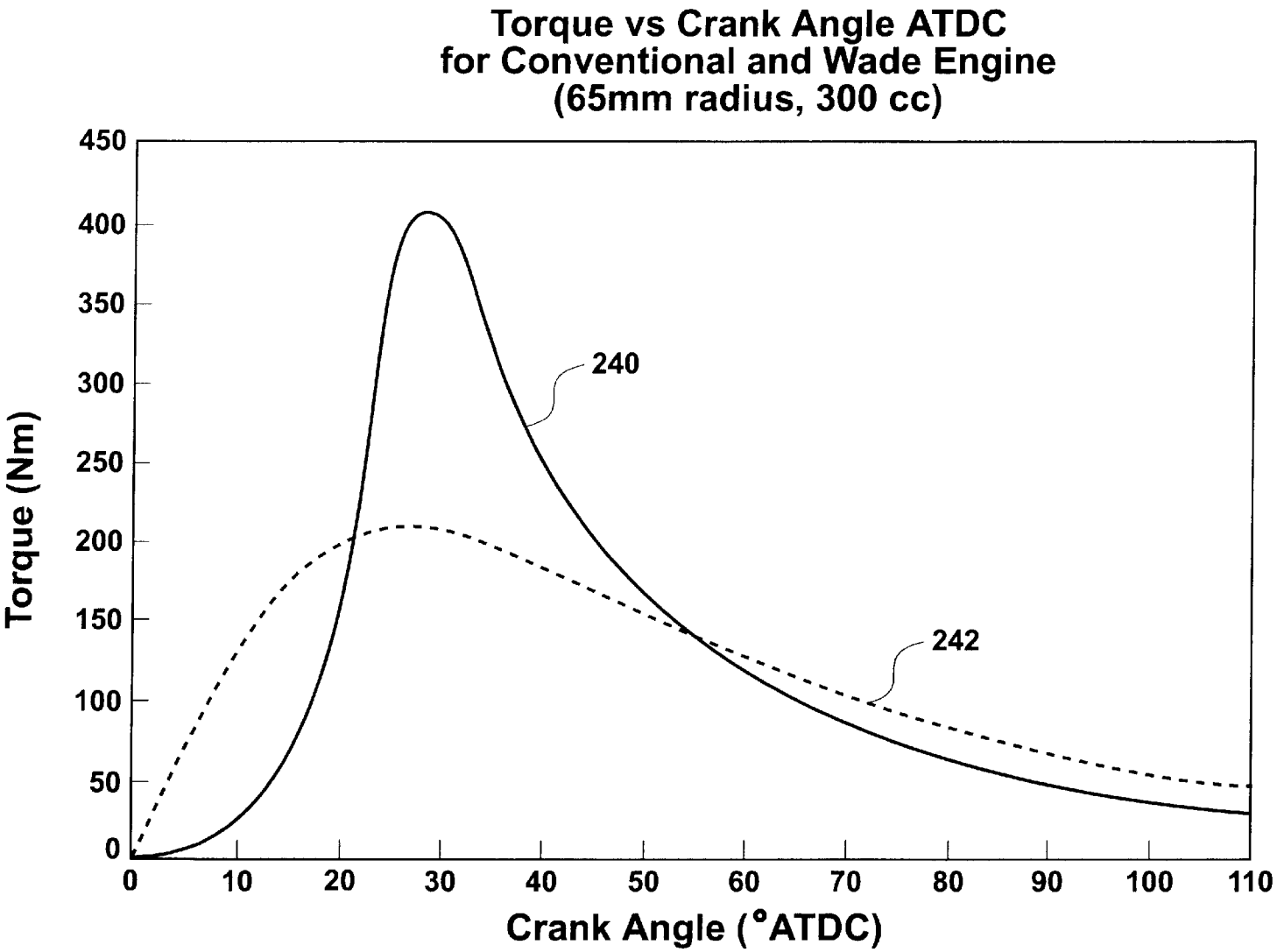
FIG. 20 is a graph of torque (Nm) vs crank angle (degrees after Top Dead Center)
Figure 21:
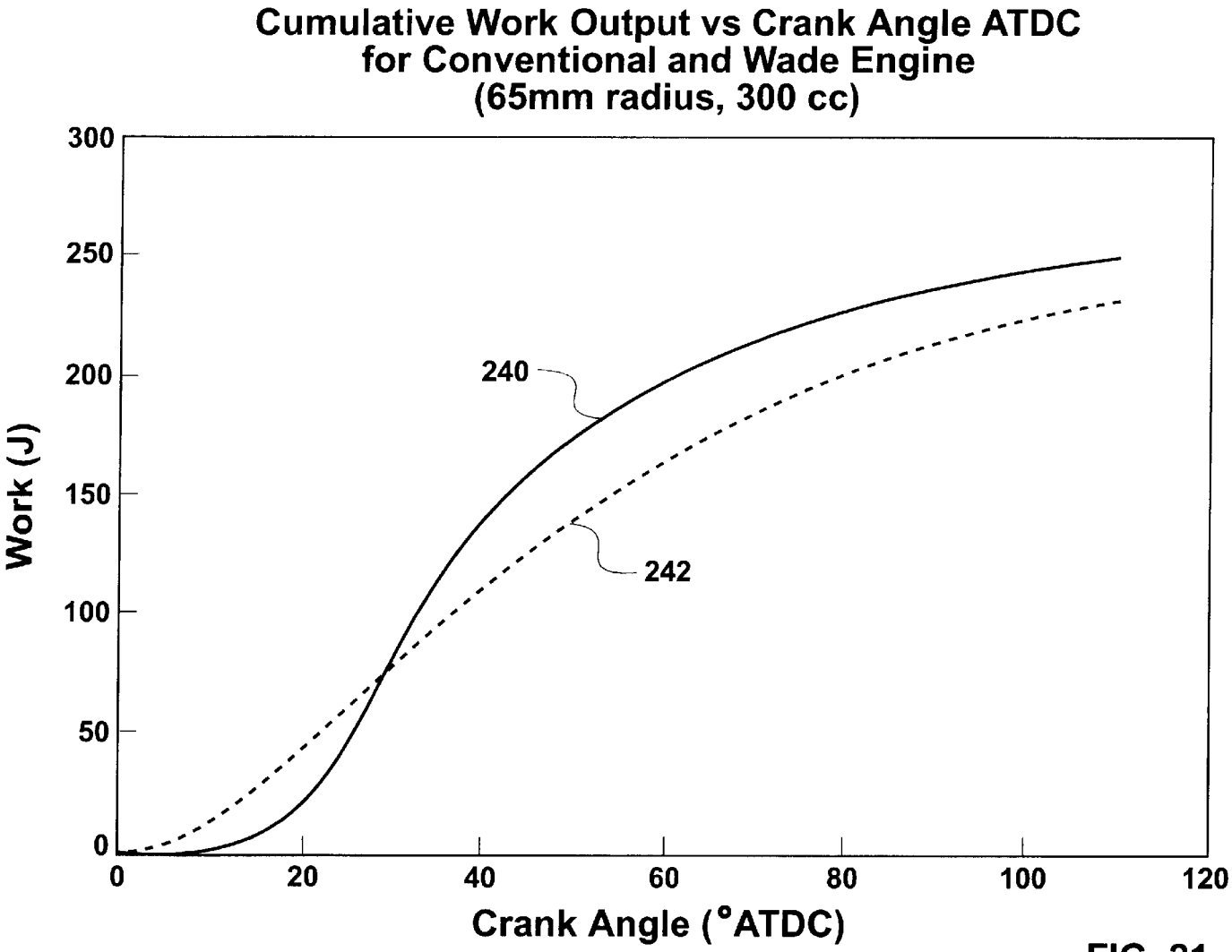
FIG. 21 is a graph of work (J) vs crank angle (degrees after Top Dead Center)
Figure 22:
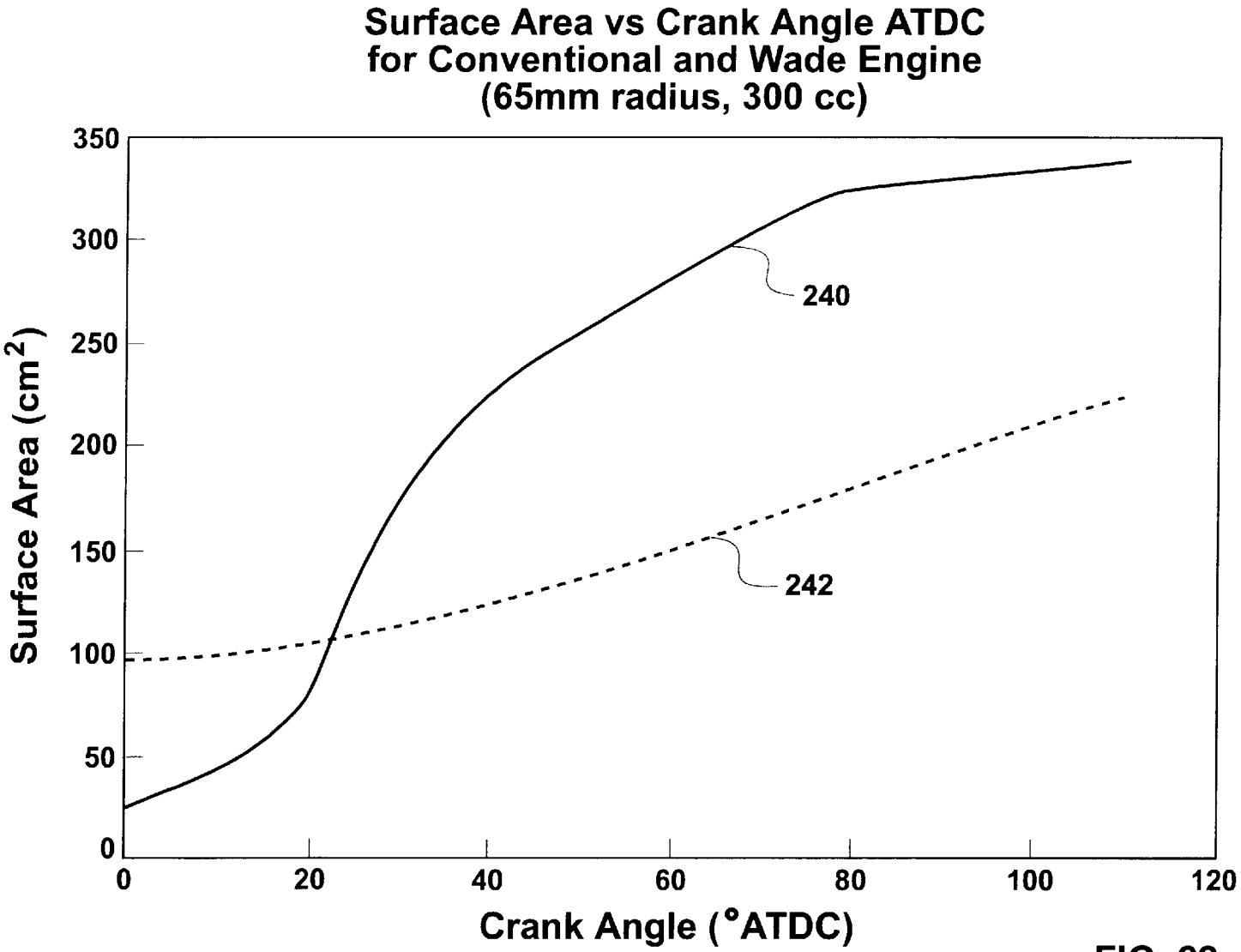
FIG. 22 is a graph of combustion chamber surface area (cubic centimetres) vs crank angle (degrees after Top Dead Center)
Figure 23:
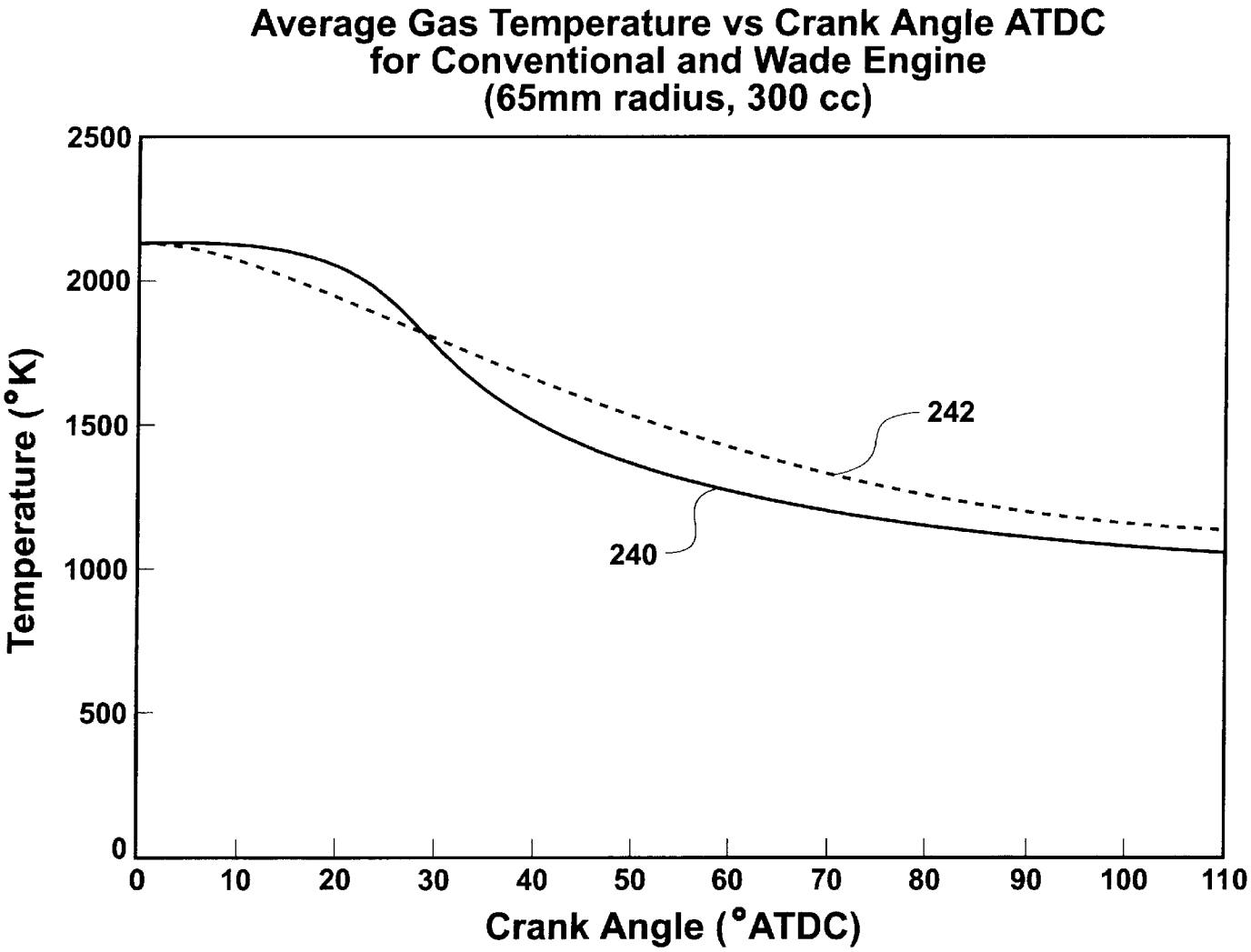
FIG. 23 is a graph of average gas temperature vs crank angle (degrees after Top Dead Center)

Software modelling using the program sold under the trade mark CATIA has produced favourable results. FIG. 17 shows a graph of gross power and gross torque against engine speed for ideal model results for the invention, based on an engine having two offset constant 65 mm radius semicircles offset by 38 mm. The swept volume of the engine is 300 cc. The assumptions for the model are:

1. compression pressure 10.9 bar (160 psi), no compression work is accounted for.
2. Constant volume combustion in hemispherical or disc (conventional) combustion chamber, at TDC, resulting in peak pressure of 44.2 bar (650 psi).
3. Expansion ratio of 9:1 from TDC to exhaust valve opening at 110 crank angle degrees after TDC. This gives a total "compression ratio" of 9.44.
4. Polytropic coefficient for expansion, n=1.32 ($PV^n$= constant).

The engine torque output is locus 230, and the power is locus 232. As can be seen, the gross torque output is constant, so the gross power increases linearly with engine speed.

FIGS. 18 to 23 are further CATIA graphs of ideal model performance of the engine of the present invention as compared to a traditional four phase reciprocating engine. In each graph the locus of the engine of the present invention is referenced 240, and that of the reciprocating engine is referenced 242. The engine of the present invention is as described above with reference to FIG. 17. The reciprocating engine was modelled has a swept volume of 300 cc, 0.9 bore to stroke ratio, connecting rod length to crank radius ratio of 3.5, and the same assumptions 1 to 4 as listed above for the present invention.

The engine and compressor of the present invention has significant advantages over the prior art. The constant torque has significant advantages for engines used for driving propellers for marine and aircraft propulsion. The invention clearly has a number of applicants apart from use as an internal combustion engine. It may be used as a steam engine for example, in which case steam would be introduced into the combustion chamber for expansion through the "combustion" phase described above, to move the rotor relative to the stator. Also, the invention liquids under pressure introduced into the combustion chamber. Gases under pressure can expand in the chamber as described above with reference to the "combustion" phase, and liquids under pressure can be allowed to continuously flow into the combustion chamber during the "combustion" phase referred to above to produce relative movement between the rotor and the stator.

Figure 24:
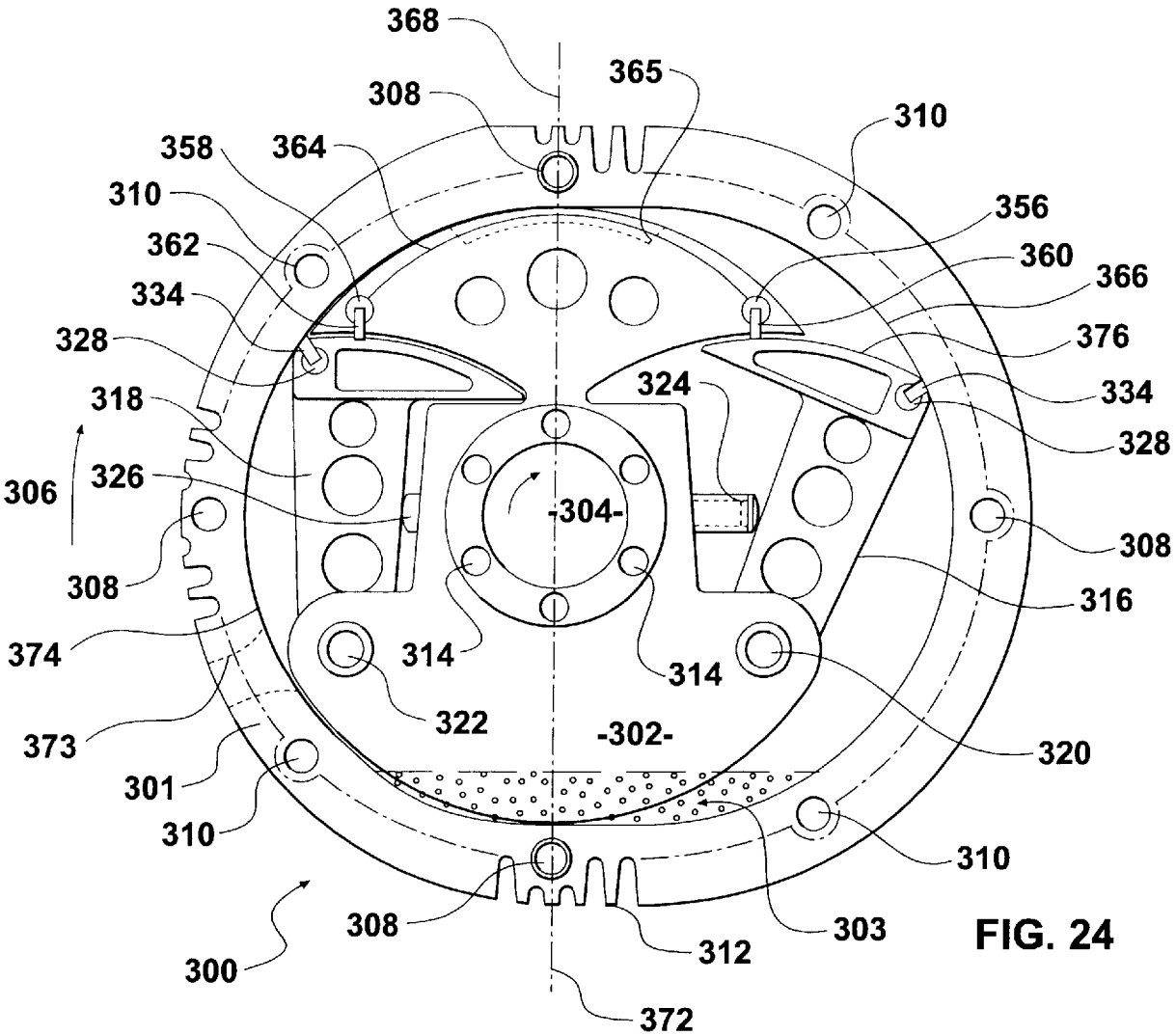
FIG. 24 is a diagrammatic side elevation in cross section of a compressor or pump in accordance with the present invention.

Referring to FIG. 24, a compressor or pump is shown, generally referenced 300. The compressor 300 is substantially the same as that referred to above in FIGS. 12, 15 and 16 using reference numeral 200, but for the purposes of the following, more detailed description, it is more conveniently described using new reference numerals. The compressor 300 may be generally referred to as a Rotary Compressor, having a stationary housing or stator 301 and a rotor 302 which is rotationally mounted relative to the stator 301 and having an input shaft 304. The normal direction of rotation of the shaft 304 and the rotor is indicated by arrow 306. The stator 301 has holes 308 and 310 about the periphery thereof. Holes 308 are used to stack compressors together, or to stack the compressor with an engine. Holes 310 are used to attach front and rear end plates to each compressor or pump as will be described further below. The stator also has cooling fins 312 which are preferably disposed about most or all of the outer periphery of the stator. Depending on the cooling method adopted, cooling fins 312 may not be required, as the compressor may be cooled by any desirable method, for example liquid cooling.

Holes 314 provided in input shaft 304 and in rotor 302 in use contain bolts for fixing the shaft to the rotor. The rotor has two moveable moveable means 316 and 318 which are leading and trailing moveable arms, respectively, and which are pivotally connected to rotor 302 by pins or the like 320 and 322. Moveable arms 316 and 318 are biased against inner walls of the stator 301 by sprung members 324 and 326, but other biasing methods could also be used. As can be seen from FIG. 24, recesses are provided in the rotor 302 to allow the moveable arms to move generally radially relative to the rotor as the rotor rotates relative to the stator.

Figures 25, 26, 27, 28, 29, 30:
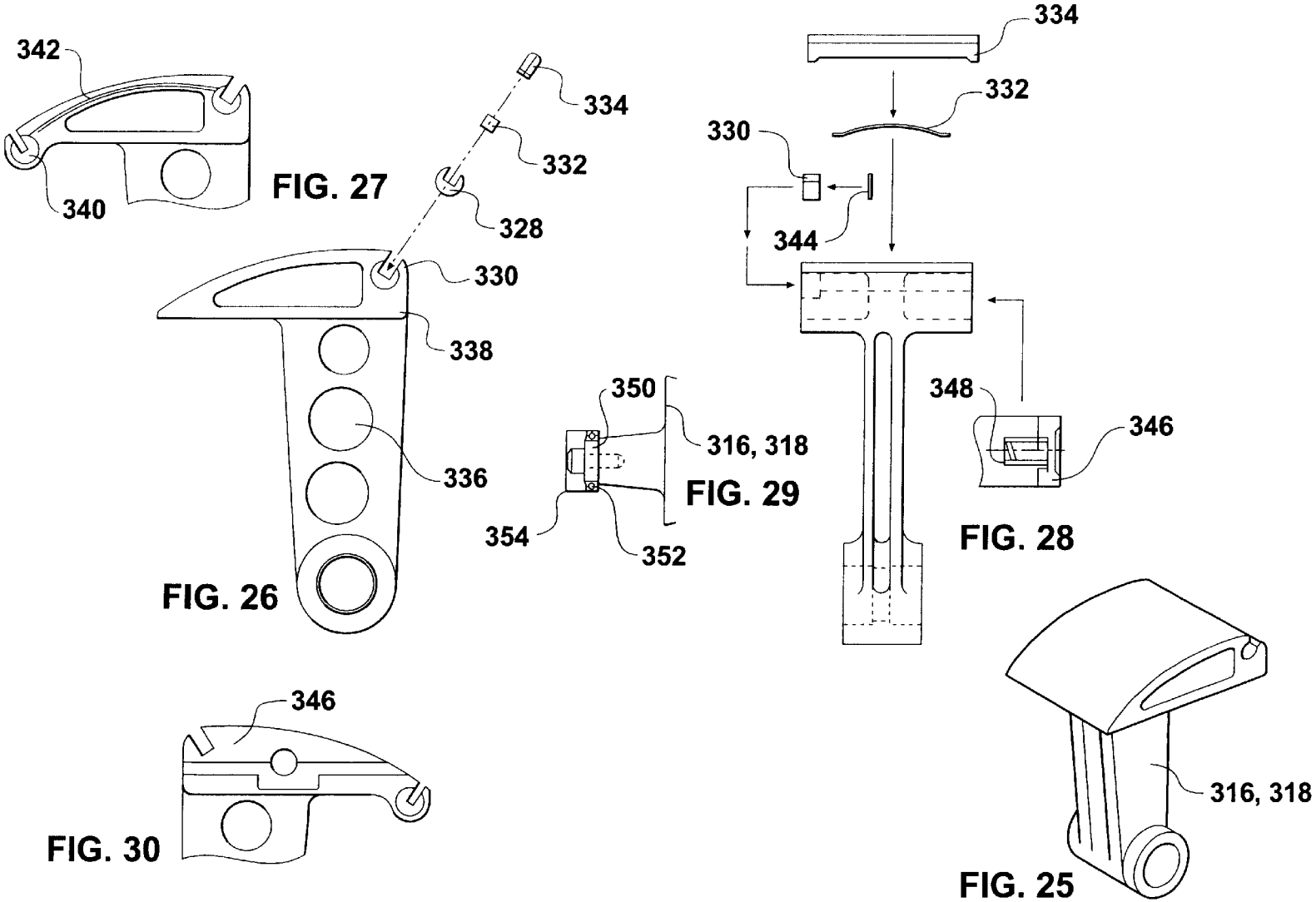
FIG. 25 is an isometric view of a moveable arm of the compressor or pump of FIG. 24.
FIG. 26 is a side elevation of the moveable arm shown in FIG. 25, showing part of the seal assembly.
FIG. 27 is a partial side elevation of an alternative moveable arm to that shown in FIGS. 25 and 26.
FIG. 28 is an exploded end elevation of another alternative moveable arm and sealing arrangement.
FIG. 29 is an end elevation of an optional guiding cam for use with the moveable arms of the preceding figures.
FIG. 30 is a partial side elevation of the moveable arm shown in FIG. 28.

Referring to FIG. 25, one of the moveable arms 316 and 318 is shown in isometric view for clarity.

The preferred moveable arm sealing arrangement is shown in FIG. 26, in which a button seal 328 is shown for location in edge 330 of the moveable arm. The button seals contains a leaf spring 332 which biases a moveable arm edge seal 334 against the inner surfaces of the stator 301. One or more holes 336 may be provided in the moveable arms to reduce their mass.

The moveable arm of FIG. 26 has side surfaces 338 which are preferably machined sufficiently accurately to provide a seal between the moveable arm and the front and/or rear end caps of the compressor or pump. Therefore, only one of seals 328 and 334 are required on each torque link arm. However, in some applications, the desired quality of the sealing surface on side surfaces 338 may not be able to be achieved, in which case the alternative shown in FIG. 27 may be used. As can be seen from FIG. 27, a further button seal 340 is provided which contains a further spring and edge seal (not shown), and a side seal 342 is provided between the two button seals.

Referring to FIG. 28, the button spring 344, which holds button seal 330 in contact with the front and/or rear end plates is shown together with another alternative sealing method which comprises a moveable arm end cap 346 which is biased against the front and/or rear end plates of the compressor or pump by spring 348. The cap is machined to provide a seal.

FIG. 29 shows a cam follower 350 which is provided on a part of the moveable arm, for example on the central web of the moveable arm, for guiding the moveable arm relative to the stator inner surface. This arrangement is necessary for some relatively large embodiments of the invention, as the mass of the rapidly rotating moveable arms imposes unacceptably high forces on the seals 334. The cam follower 350 is shown within a ball race 352 so that it may move relative to a groove 354 provided in a wall of the front or rear end plates of the compressor or pump. In this arrangement the moveable arm load is carried by the front or rear end plates rather than the seals 334.

FIG. 30 shows a side elevation of the moveable arm end cap 346 of FIG. 28.

Referring again to FIG. 24, the rotor 302 has button seals 356 and 358 which contain edge seals 360 and 362. Between these seals, an edge seal 364 is provided.

In the position shown in FIG. 24, the compressor is part way through the inlet phase. Moveable arm 316 has moved radially pivotally away from the center of rotor 302 as it follows the contour of the profiled inner surface 366 of the stator which in FIG. 24 extends from Top Dead Center (TDC, zero crank angle degrees) at 368 to point 372. Inlet occurs until the trailing arm passes the inlet port 370, but could be varied with variations in compressor design. The remainder of the inner surface, which is preferably concentric, and almost conterminous with the outer periphery of the body of the rotor 302, is referenced 374. The angular extent of the surfaces 366 and 374 can be varied as long as the area 376 of the leading moveable arm 316 that is exposed to gases that are being compressed is greater than exposed area 377 of the trailing moveable arm 318 while the trailing moveable arm is in the compression phase after passing inlet 370.

The compression chamber is effectively provided between the sealing edge surfaces of moveable arms 316 and 318, seals 328 and 334 of each moveable arm, seals 356, 358, 360, 362 and 364, and the inner surfaces 370 and 374. The edge seal 364 is curved so that it is not concentric with the rotor to prevent it wearing a groove in the inner surfaces of the end caps. A compression region or "cell" 365 is provided in the rotor to provide a predetermined volume of space for the compressed gases to occupy.

Figure 31:
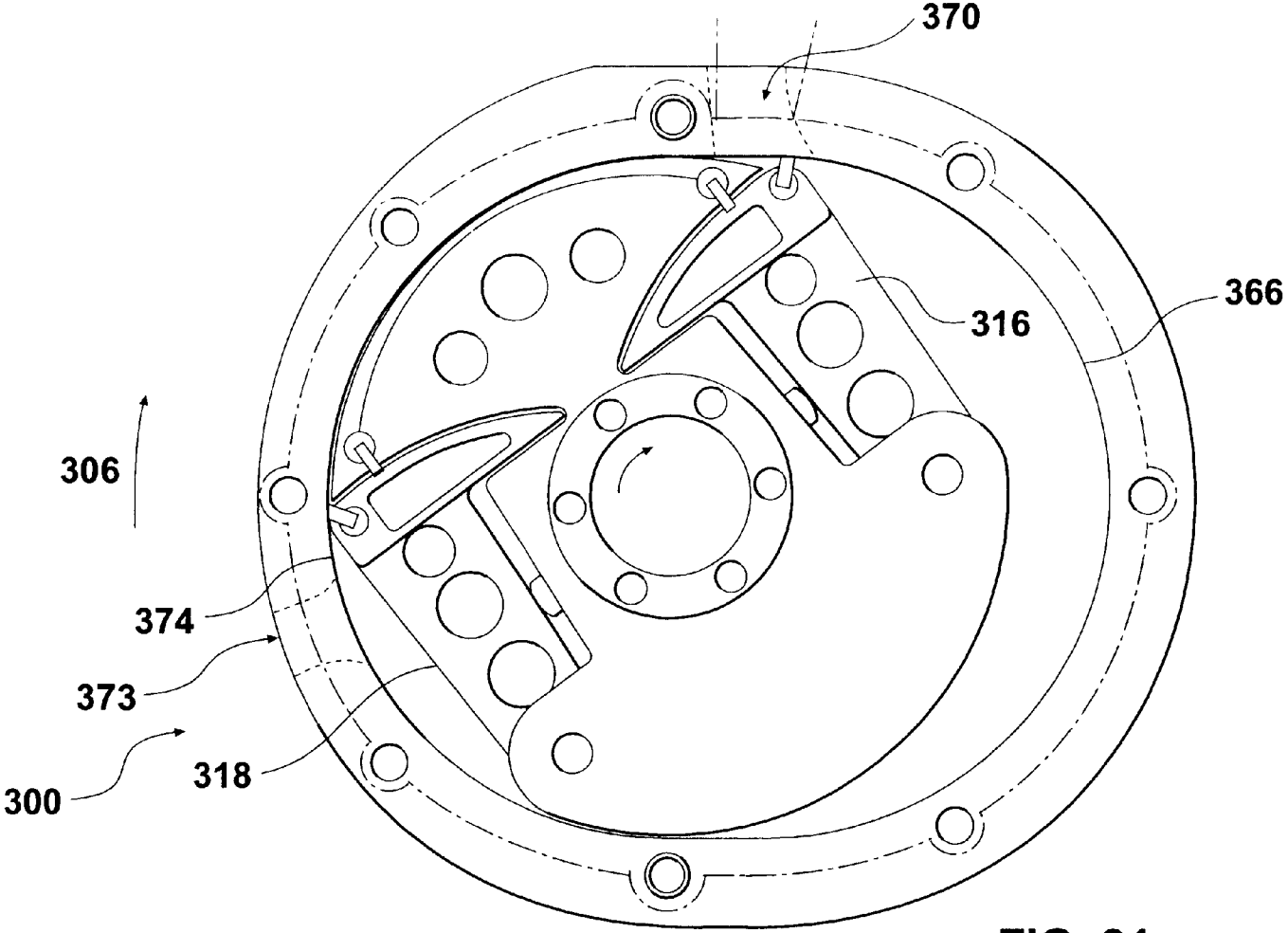
FIGS. 31, 32, and 33 are diagrammatic side elevations in cross section of the compressor or pump of FIG. 24 during the compression cycle, at exhaust, and at TDC ready for compression, respectively.

Referring to FIG. 31, inlet port 370 has effectively been "opened" as the leading moveable arm 316 has passed over it. As the leading moveable arm follows contour 366 of the stator inner wall, the volume between the moveable arms will increase rapidly, drawing gases through the inlet port 370. After trailing moveable arm 318 passes over the inlet port, the inlet gases are trapped between the moveable arms.

Figure 32:
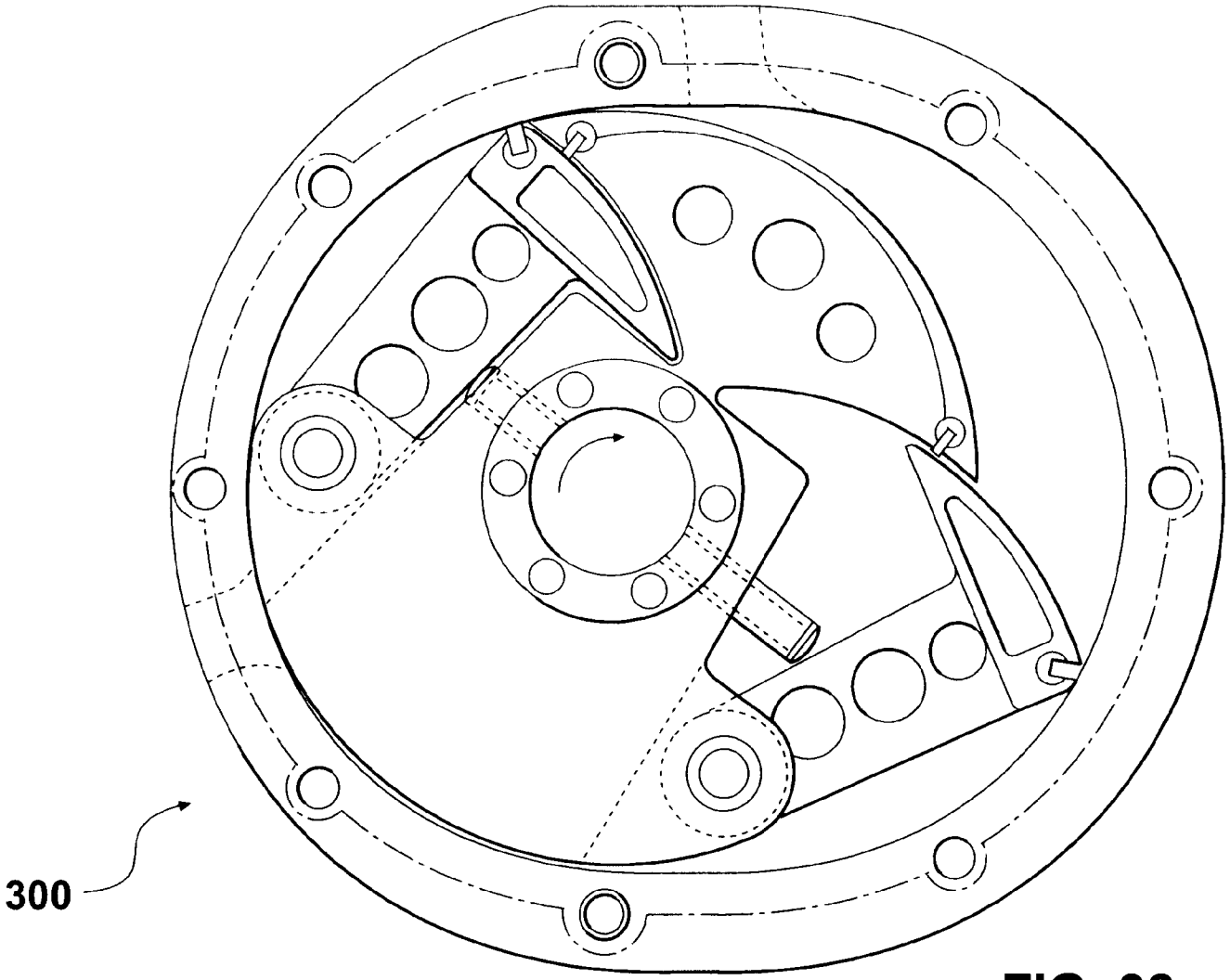

Referring to FIG. 32, the engine is shown just prior to the inlet port 370 being effectively closed by trailing arm 318 passing over it. It will be seen that the volume of the compression chamber is almost at a maximum as the compression phase is about to begin.

Figure 33:
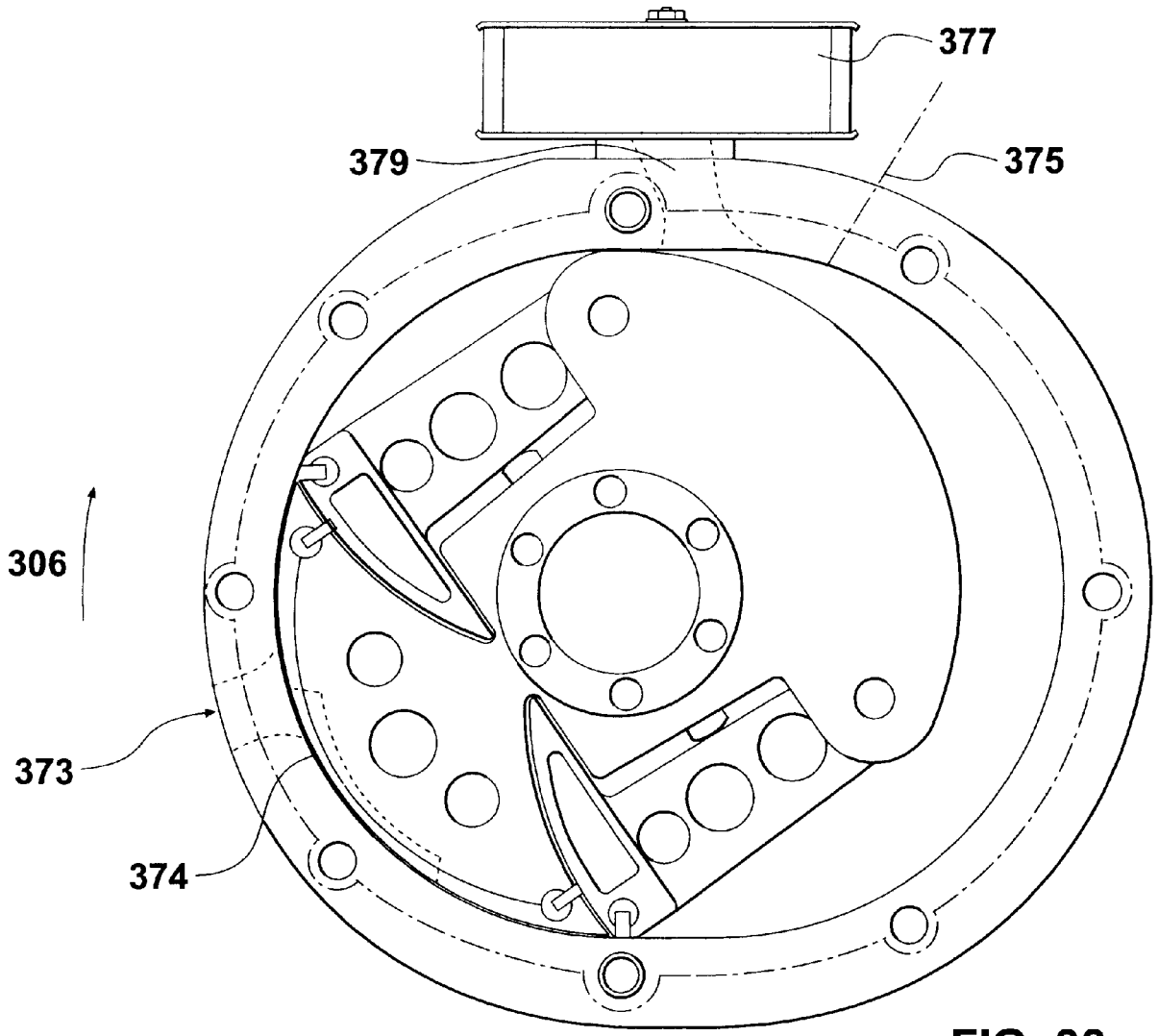

In FIG. 33 the rotor has rotated to a position in which compressed gases are exiting the compressor through the outlet port 373. The gases are compressed by the reduction in volume as the trailing moveable arm 318 is forced back toward the body of the rotor 302 by the inner surface profile 336 as it returns to inner surface 374 as shown in FIG. 16. An optional air filter 377 is also shown adjacent to the inlet 379. If the compressed gases are to be supplied to an engine, then a fuel injector may be provided at position 375 in the stator 302. Alternatively, rather than a fuel injector, a lubricant injector if required. Referring again to FIG. 24, lubricant 303 may be provided in part of the stator. As can be seen from FIG. 24, the lubricant will be scraped up by the leading moveable arm and distributed to parts of the rotor as it rotates.

Figure 34:
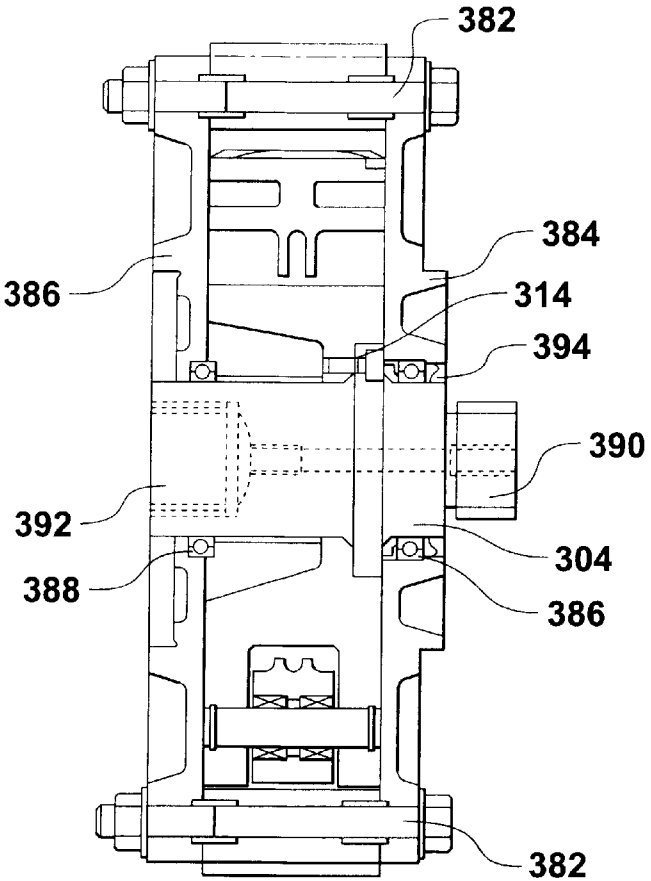
FIG. 34 is a diagrammatic end elevation in cross section of the compressor or pump of FIGS. 24 to 33.

FIG. 34 shows the compressor in end elevation in cross section, in which tie bolts 382 hold the front and rear end plates 384 and 386 in place either side of the stator. The output shaft 304 is supported by bearings 386 and 388 and includes male and female splines 390 and 392 for stacking engine and compressor modules together, or stacking engines and compressors as will be described further below. A seal 394 is provided between the front end cap 384 and the shaft 304.

Figure 35:
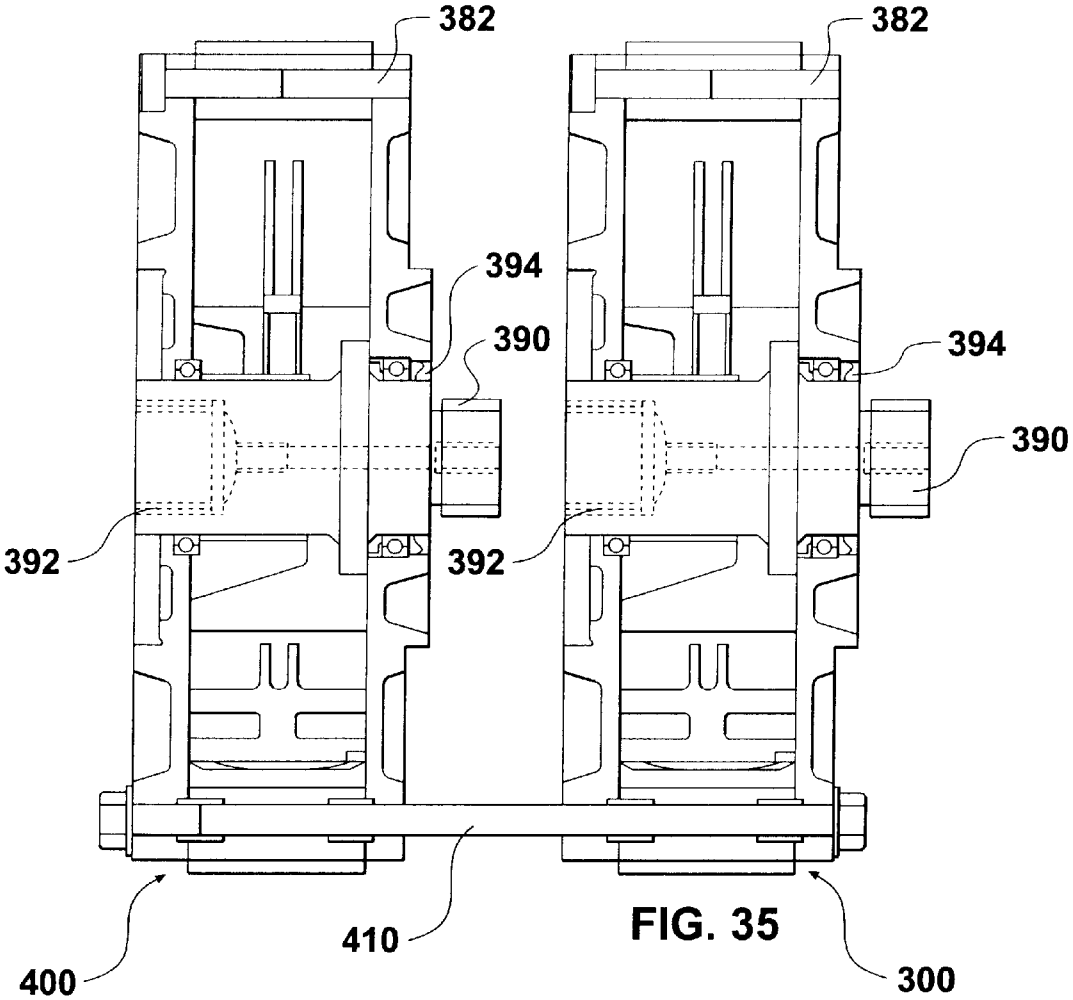
FIG. 35 is a diagrammatic end elevation in cross section of the compressor or pump of the preceding figures shown stacked with another compressor or an engine.

Turning to FIG. 35, a compressor or pump 300 as shown in the preceding figures is shown ready to be stacked with another compressor 400. Alternatively, module 400 can be an engine, such as the engine described in our copending application entitled "Improvements in or Relating to Engines and/or Motors", filed Sep. 27, 1995, the disclosure of which is incorporated herein by reference. Tie bolts 430 are used to connect the two (or more) modules together.It will be seen that the design is such that any number of compressor and engine modules can be stacked together.

As can be seen from FIG. 35, male spline 390 of the compressor input shaft engages with the female spline 392 of the engine output shaft. The compressor is therefore driven by the engine, and the outlet port 373 of the compressor is connected through the stator 301 to inlet port 412 of the engine. A desired relative angular position between the engine and compressor rotors can be established so that compressed combustible gases are supplied to the engine at the required time. This can be varied to provide desired compression ratios, and desired timing of gases transfer which may be dependent on the speed the engine is to operate at, for example. Bolts 410 are used to fixedly stack the engine 300 and the compressor 400 together.

Figure 36:
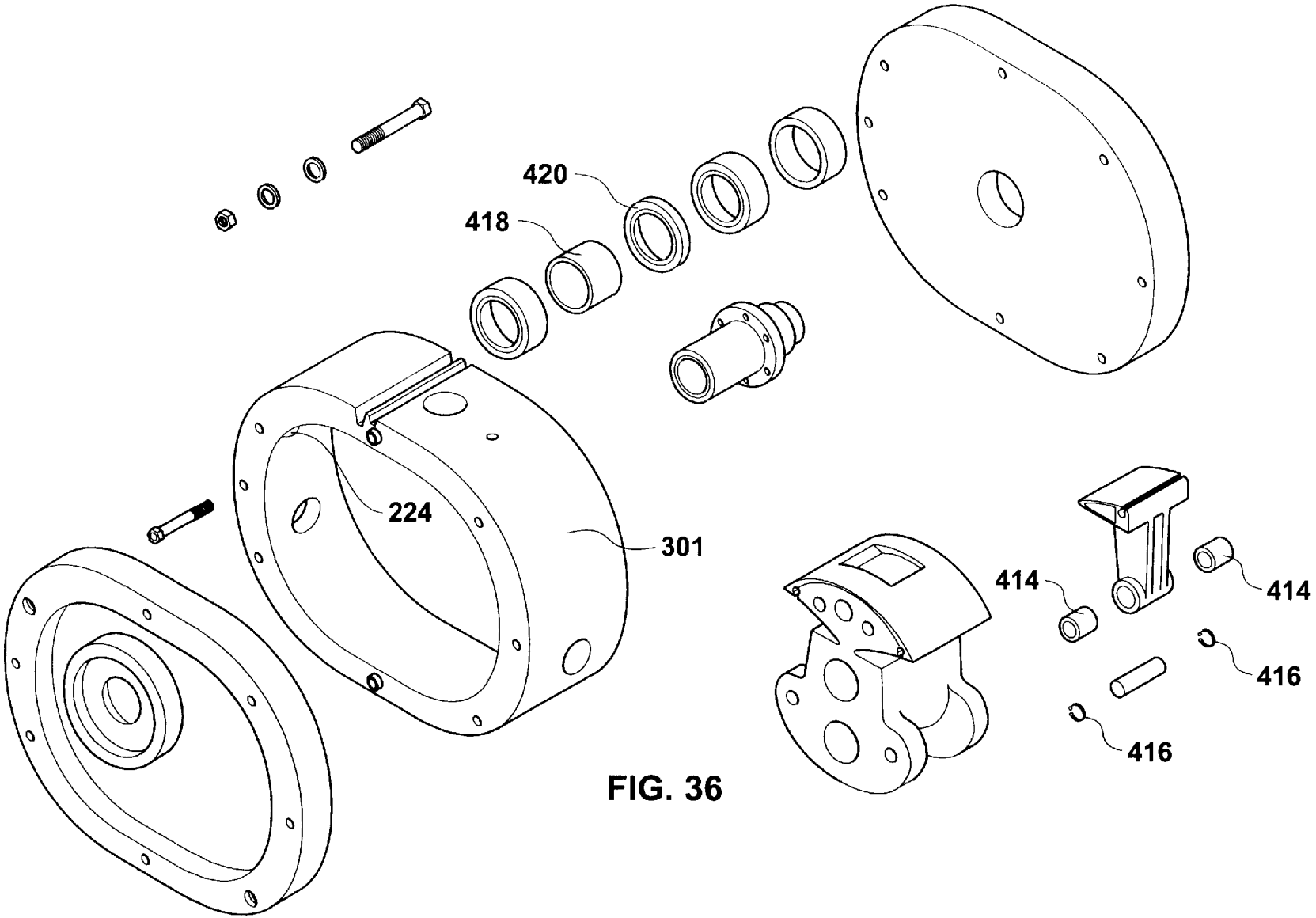
FIG. 36 is a diagrammatic exploded isometric view of the compressor or pump of the preceding figures.

An exploded view of the compressor 300 is shown in FIG. 36, in which moveable arm bearings 414 and circlips 416 can be seen, together with shaft spacers 418 and 420. The compressor may be a stand alone unit. It could be driven by a conventional engine or an electric motor, for example, to provide a supply of compressed gases.

Thus the compression ratios can be easily varied by substitution or redesign of the compressor module. Any number of engine and compressor units, within reason, may be interconnectably stacked together by means of interconnecting splines 390 and 392 of alternate engine and compressor units so that the arrangement shown in FIG. 35 is duplicated. The interconnected units can be held in stacked position by bolts 410, which are provided in appropriately varying lengths. Thus a plurality of engine and compressor units may be stacked together to multiply the power output of a single engine and compressor unit. The relative angular position of interconnected compressor units can be varied to provide a required torque profile for the driving apparatus. For example, if two compressors are connected in phase, the torque required throughout the compression phase will be doubled, whereas if they are connected 180 degrees out of phase, the torque required will be distributed.

As described above, the variation in torque through the compression phase, and the volume and pressure of fluids delivered by the apparatus, can be varied by design, as these are dependent on the contour of the profiled inner surface 366.

The trailing moveable arm of the present invention provides two distinct advantages over the prior art. The pivotal connection between the moveable arm and the rotor, and the ability of the trailing moveable arm to follow the inner surfaces 366 and 374 of the stator, provides a superior seal to that of the prior art and thus allows much higher compression ratios to be achieved with the present invention, with the result that the compressor is more efficient than prior art embodiments.

The embodiment of the present invention described with reference to the preceding drawings has a minimal number of components, however, it can also be seen that more than two moveable arms could be provided.

The rotors of both the compressor and the engine are identical, thus leading to simpler manufacture and reduced cost of manufacture.

The compressor or pump of the present invention has significant advantages over the prior art. The invention clearly has a number of applications apart from use as a compressor alone. It may also be used as a pump or vacuum pump for liquids or gases. Significant compression ratios can be achieved, for example up to 2000 psi. Furthermore, it will be seen that the operation of the compressor or pump can be reversed so that a motor is provided. Thus fluids, such as liquids under pressure, or compressed gases, can be supplied to the working chamber (that in the foregoing description effects compression) and use the chamber as an expansion chamber to produce rotational movement. Thus the invention also provides motors such as air motors and hydraulic motors for example.

What is claimed is:

1. An engine including:

a stator, a rotor rotatably mounted within the stator, the stator having side walls substantially perpendicular to the axis of rotation of the rotor and a circumferential wall substantially parallel to the axis of rotation of the rotor, an inlet for supply of an inlet fluid to the engine and an exhaust to allow expanded or combusted fluid to escape from the engine, and at least one of the side walls having a cam guide means, the circumferential wall including a concentric region being substantially concentric with and close to the rotor, and an expansion region being substantially spaced from the rotor, two moveable arms, each moveable arm being pivotally mounted on the rotor by a pivot mounting adjacent to one end of the arm whereby each arm is radially moveable relative to the rotor, and the arms are arranged so that one arm leads its respective pivot mounting and the other arm lags its respective pivot mounting upon rotation of the rotor, and a cam following means on each arm, an expansion chamber provided between the expansion region of the circumferential wall, the side walls of the stator, the rotor and both the moveable arms, expansion or combustion of inlet fluid in the expansion chamber in use causing rotation of the rotor relative to the stator, a seal provided between each of the moveable arms and the circumferential wall, the cam following means being engaged with the cam guide means to maintain the moveable arms adjacent to the circumferential wall as the rotor rotates relative to the stator and to prevent centrifugal forces of each arm from being imposed on the seal.

2. An engine as claimed in claim 1 wherein each movable arm has an expansion chamber surface that forms part of the expansion chamber, one of the moveable arms being a leading moveable arm, and the other being a trailing moveable arm, the leading movable arm leading the trailing moveable arm in the direction of rotation of the rotor, and the trailing moveable arm being in the concentric region while the leading moveable arm is in the expansion region whereby the area of the expansion chamber surface of the leading moveable arm varies as the leading moveable arm traverses the expansion region while the area of the expansion chamber surface of the trailing moveable arm remains substantially constant.

3. An engine as claimed in claim 2 wherein the profile of the expansion region allows progressive radial movement of the leading moveable arm in a direction away from the axis of rotation of the rotor as the leading moveable arm traverses the expansion region to thereby progressively increase the area of the expansion chamber surface of the leading moveable arm as the leading moveable arm traverses the expansion region.

4. An engine as claimed in claim 1 wherein the seal includes a sealing member and biasing means to bias the sealing member against the circumferential wall.

5. An engine as claimed in claim 1 wherein the beginning and end of the expansion region coincide with and are substantially tangential to the end and the beginning of the concentric region.

6. An engine as claimed in claim 1 wherein a compressor is also provided, the compressor having an outlet in fluid communication with the inlet of the engine to provide compressed fluid to the engine.

7. An engine as claimed in claim 6 wherein an engine output shaft is provided connected to the rotor and the compressor includes a drive shaft for driving the compressor, the drive shaft being directly connected to the output shaft whereby the engine drives the compressor.

8. An engine as claimed in claim 7 wherein the engine includes attachment means for attachment of the compressor to the engine in a plurality of relative angular positions to allow selective variation of compression of fluid or timing of fluid transfer between the engine and the compressor.

9. A compressor including:

a stator, a rotor rotatably mounted within the stator, the stator having side walls substantially perpendicular to the axis of rotation of the rotor and a circumferential wall substantially parallel to the axis of rotation of the rotor, an inlet for supply of an inlet fluid to the compressor and an outlet to allow compressed inlet fluid to escape from the engine, and at least one of the side walls having a cam guide means, the circumferential wall including a concentric region being substantially concentric with and close to the rotor, and a compression region being substantially spaced from the rotor, two moveable arms, each moveable arm being pivotally mounted on the rotor by a pivot mounting adjacent to one end of the arm whereby each arm is radially moveable relative to the rotor, and the arms are arranged so that one arm leads its respective pivot mounting and the other arm lags its respective pivot mounting upon rotation of the rotor, and a cam following means on each arm, a compression chamber provided between the compression region of the circumferential wall, the side walls of the stator, the rotor and both the moveable arms, rotation of the rotor relative to the stator in use causing compression of inlet fluid in the compression chamber, a seal provided between each of the moveable arms and the circumferential wall, the cam following means being engaged with the cam guide means to maintain the moveable arms adjacent to the circumferential wall as the rotor rotates relative to the stator and to prevent centrifugal forces of each arm from being imposed on the seal.

10. A compressor as claimed in claim 9 wherein each moveable arm has a compression chamber surface that forms part of the compression chamber, one of the moveable arms being a leading moveable arm, and the other being a trailing moveable arm, the leading moveable arm leading the trailing moveable arm in the direction of rotation of the rotor, and the leading arm being in the concentric region while the trailing moveable arm is in the compression region whereby the area of the compression chamber surface of the trailing moveable arm varies as the trailing moveable arm traverses the compression region while the area of the compression chamber surface of the leading moveable arm remains substantially constant.

11. A compressor as claimed in claim 10 wherein the profile of the compression region allows progressive radial movement of the trailing moveable arm in a direction toward the axis of rotation of the rotor as the trailing moveable arm traverses the compression region to thereby progressively decrease the area of the compression chamber surface of the trailing moveable arm as the trailing moveable arm traverses the expansion region.

12. A compressor as claimed in claim 9 wherein the seal includes a sealing member and biasing means to bias the sealing member against the circumferential wall.

13. A compressor as claimed in claim 9 wherein the beginning and end of the compression region coincide with and are substantially tangential to the end and the beginning of the concentric region.

* * * * *